US010690288B2

(12) United States Patent
Griffith et al.

(10) Patent No.: US 10,690,288 B2
(45) Date of Patent: Jun. 23, 2020

(54) SYSTEM AND METHOD FOR A CONFORMABLE PRESSURE VESSEL

(71) Applicant: Other Lab, LLC, San Francisco, CA (US)

(72) Inventors: Saul Griffith, San Francisco, CA (US); Rustie McCumber, Albany, CA (US); Shara Maikranz, San Francisco, CA (US); Jonathan Ward, San Francisco, CA (US); Tucker Gilman, San Francisco, CA (US)

(73) Assignee: OTHER LAB, LLC, San Francisco, CA (US)

( * ) Notice: Subject to any disclaimer, the term of this patent is extended or adjusted under 35 U.S.C. 154(b) by 622 days.

(21) Appl. No.: 15/183,614

(22) Filed: Jun. 15, 2016

(65) Prior Publication Data

US 2016/0363265 A1 Dec. 15, 2016

Related U.S. Application Data

(60) Provisional application No. 62/175,914, filed on Jun. 15, 2015.

(51) Int. Cl.

| | |
|---|---|
| ***F17C 1/06*** | (2006.01) |
| ***F17C 1/16*** | (2006.01) |
| *F17C 1/08* | (2006.01) |

(52) U.S. Cl.

CPC ..... *F17C 1/16* (2013.01); *F17C 2201/0138* (2013.01); *F17C 2201/0166* (2013.01);

(Continued)

(58) Field of Classification Search

CPC ..... F17C 1/16; F17C 2201/0138; F17C 2201/0166; F17C 2201/056;

(Continued)

(56) References Cited

U.S. PATENT DOCUMENTS

| | | | |
|---|---|---|---|
| 2,025,038 | A | 12/1935 | Cannon |
| 2,380,372 | A | 7/1945 | Alderfer |

(Continued)

FOREIGN PATENT DOCUMENTS

| | | | |
|---|---|---|---|
| CA | 2636100 | A1 | 12/2009 |
| CN | 1036534 | A | 10/1989 |

(Continued)

OTHER PUBLICATIONS

International Search Report and Written Opinion dated Aug. 27, 2013, International Patent Application No. PCT/US2013/039565, filed May 3, 2013, 13 pages.

(Continued)

*Primary Examiner* — J. Gregory Pickett
*Assistant Examiner* — Niki M Eloshway
(74) *Attorney, Agent, or Firm* — Davis Wright Tremaine LLP

(57) ABSTRACT

A vessel for storing fluid, the vessel including a liner having a liner body that defines: a liner cavity; a plurality of flexible connector portions that include a corrugated length that provides for flexibility of the respective connector portions, the connector portions having a first maximum diameter; a plurality of elongated tubing portions between the respective flexible connector portions, the elongated tubing portions having a second minimum diameter that is larger than the first maximum diameter of the flexible connector portions; and a plurality of taper portions coupling adjoining flexible connector portions and tubing portions configured to provide a transition between a smaller diameter of the connector portion and a larger diameter of the tubing portion.

13 Claims, 17 Drawing Sheets

(52) U.S. Cl.
CPC ..... *F17C 2201/0195* (2013.01); *F17C 2201/056* (2013.01); *F17C 2203/0604* (2013.01); *F17C 2203/0619* (2013.01); *F17C 2203/0621* (2013.01); *F17C 2203/0624* (2013.01); *F17C 2203/0663* (2013.01); *F17C 2205/0111* (2013.01); *F17C 2205/0138* (2013.01); *F17C 2209/2109* (2013.01); *F17C 2209/2118* (2013.01); *F17C 2209/2127* (2013.01); *F17C 2209/2154* (2013.01); *F17C 2209/2163* (2013.01); *F17C 2209/221* (2013.01); *F17C 2221/033* (2013.01); *F17C 2223/0123* (2013.01); *F17C 2223/035* (2013.01); *F17C 2270/0168* (2013.01)

(58) Field of Classification Search
CPC ..... F17C 2203/0619; F17C 2203/0621; F17C 2203/0624; F17C 2203/0663
USPC ..... 220/589, 666, 672
See application file for complete search history.

(56) References Cited

U.S. PATENT DOCUMENTS

| | | | | |
|---|---|---|---|---|
| 3,579,402 | A | 5/1971 | Goldsworthy | |
| 4,139,019 | A | 2/1979 | Bresie et al. | |
| 4,253,454 | A | 3/1981 | Warncke | |
| 4,432,302 | A | 2/1984 | Farris et al. | |
| 4,932,403 | A | 6/1990 | Scholley | |
| 5,036,845 | A | 8/1991 | Scholley | |
| 5,040,933 | A | 8/1991 | Lee et al. | |
| 5,127,307 | A | 7/1992 | Pimpis | |
| 5,653,358 | A | 8/1997 | Sneddon | |
| 5,830,400 | A * | 11/1998 | Huvey | F16J 12/00 264/254 |
| 5,839,383 | A | 11/1998 | Stenning et al. | |
| 6,047,860 | A * | 4/2000 | Sanders | F17C 1/00 222/206 |
| 6,116,464 | A | 9/2000 | Sanders | |
| 6,293,590 | B1 | 9/2001 | Ogasa | |
| 6,453,920 | B1 | 9/2002 | Izuchukwu et al. | |
| 6,494,497 | B1 | 12/2002 | Kertesz | |
| 6,513,523 | B1 | 2/2003 | Izuchukwu et al. | |
| 6,527,075 | B1 | 3/2003 | Izuchukwu et al. | |
| 6,579,401 | B1 | 6/2003 | Izuchukwu et al. | |
| 6,676,159 | B1 | 1/2004 | Sellergren | |
| 7,757,727 | B2 | 7/2010 | Handa | |
| 9,217,538 | B2 | 12/2015 | Griffith et al. | |
| 9,279,541 | B2 | 3/2016 | Cohen | |
| 9,850,852 | B2 | 12/2017 | Kondogiani et al. | |
| 2004/0145091 | A1 | 7/2004 | Willig et al. | |
| 2004/0216656 | A1 | 11/2004 | Fitzpatrick et al. | |
| 2004/0250871 | A1 | 12/2004 | Bingham et al. | |
| 2004/0256016 | A1 | 12/2004 | Arima et al. | |
| 2005/0205137 | A1 | 9/2005 | Pouchkarev | |
| 2006/0006645 | A1 | 1/2006 | Mukawa et al. | |
| 2007/0075085 | A1 | 4/2007 | Arnold et al. | |
| 2007/0221281 | A1 | 9/2007 | Takagi | |
| 2008/0098562 | A1 | 5/2008 | Tagliaferri et al. | |
| 2009/0308475 | A1 | 12/2009 | Stringfellow et al. | |
| 2010/0075200 | A1 | 3/2010 | Hatta | |
| 2011/0041518 | A1 | 2/2011 | Peterson et al. | |
| 2012/0161434 | A1 | 6/2012 | Wells | |
| 2013/0092311 | A1 | 4/2013 | Kobayashi | |
| 2013/0092561 | A1* | 4/2013 | Wellnitz | F17C 1/005 206/0.6 |
| 2013/0125740 | A1 | 5/2013 | Kang et al. | |
| 2013/0154257 | A1 | 6/2013 | Ault | |
| 2013/0299503 | A1 | 11/2013 | Griffith et al. | |
| 2014/0305951 | A1 | 10/2014 | Griffith et al. | |
| 2015/0034233 | A1 | 2/2015 | Hatta et al. | |
| 2015/0048095 | A1 | 2/2015 | Sanders | |
| 2015/0177172 | A1 | 6/2015 | Upasani et al. | |
| 2015/0308621 | A1 | 10/2015 | Mathison | |
| 2016/0018057 | A1 | 1/2016 | Griffith et al. | |
| 2016/0363265 | A1 | 12/2016 | Griffith et al. | |
| 2017/0145961 | A1 | 5/2017 | Myers et al. | |
| 2017/0159862 | A1 | 6/2017 | Vizzarri | |
| 2018/0029465 | A1 | 2/2018 | Abd Elhamid et al. | |
| 2018/0080609 | A1 | 3/2018 | Abd Elhamid et al. | |
| 2018/0111302 | A1 | 4/2018 | Kondogiani et al. | |
| 2019/0264839 | A1 | 8/2019 | Powell et al. | |

FOREIGN PATENT DOCUMENTS

| | | | |
|---|---|---|---|
| CN | 1231639 | A | 10/1999 |
| CN | 2416338 | Y | 1/2001 |
| CN | 1306173 | A | 8/2001 |
| CN | 2542907 | Y | 4/2003 |
| CN | 1518511 | A | 8/2004 |
| EP | 0767338 | A2 | 4/1997 |
| EP | 2404872 | A1 | 1/2012 |
| EP | 3141793 | A1 | 3/2017 |
| RU | 42863 | U1 | 12/2004 |
| RU | 81568 | RU | 3/2009 |
| RU | 2426024 | C2 | 8/2011 |
| RU | 141427 | U1 | 6/2014 |
| WO | 9012982 | A1 | 11/1990 |
| WO | 9814362 | A1 | 4/1998 |
| WO | 200195967 | A1 | 12/2001 |
| WO | 2001095966 | A1 | 12/2001 |
| WO | 0239010 | A2 | 5/2002 |
| WO | 2008081401 | A1 | 7/2008 |
| WO | 2010107317 | A1 | 9/2010 |
| WO | 2013056785 | A2 | 4/2013 |
| WO | 2013166452 | A1 | 11/2013 |
| WO | 2014123928 | A1 | 8/2014 |

OTHER PUBLICATIONS

International Search Report and Written Opinion dated Mar. 16, 2017, International Patent Application No. PCT/US2016/064796, filed Dec. 2, 2016, six pages.
International Search Report and Written Opinion dated Mar. 23, 2017, International Patent Application No. PCT/US2016/037633, eight pages.
International Search Report and Written Opinion dated May 14, 2014, International Patent Application No. PCT/US2014/014729, filed Feb. 4, 2014, 11 pages.
International Search Report and Written Opinion dated Feb. 21, 2018, International Patent Application No. PCT/US2017/058068, filed Oct. 24, 2017, 8 pages.
International Search Report and Written Opinion dated Jun. 21, 2018, International Patent Application No. PCT/US2018/025280, filed Mar. 29, 2018, 7 pages.
International Search Report and Written Opinion dated Jun. 28, 2018, International Patent Application No. PCT/US2018/025283, filed Mar. 29, 2018, 8 pages.
Extended European Search Report issued in EP Patent Application No. 16871653.8, dated Oct. 25, 2018, six pages.
DeMiguel et al., "The role of initial tank temperature on refuelling of on-board hydrogen tanks," Nov. 20, 2015, available online Apr. 22, 2016, retrieved Jul. 18, 2019, from https://www.sciencedirect.com/science/article/pii/S0360319915315391, 10 pages.
Reddi et al., "Impact of hydrogen SAE J2601 fueling methods on fueling time of light-duty fuel cell electric vehicles," May 16, 2017, retrieved Jul. 18, 2019, from https://www.osti.gov/servlets/purl/1389635, 23 pages.
Schneider, "SAE J2601—Worldwide Hydrogen Fueling Protocol: Status, Standardization & Implementation," Jul. 10, 2012, retrieved Jul. 18, 2019, from https://ww2.energy.ca.gov/contracts/notices/2012-07-10_workshop/presentations/SAE_Jesse_Schneider_Fueling_Protocol.pdf, 32 pages.
U.S. Appl. No. 15/232,355, filed Aug. 9, 2016.
U.S. Appl. No. 15/627,814, filed Jun. 20, 2017.
U.S. Appl. No. 16/222,872, filed Dec. 17, 2018.

* cited by examiner 100
105
106
107
115
120
X 100
105
106
107
115
120
X 200
205
206
207
220
225
X 200
205
220
100
107
506
500
505
507
X
550
560
550A

SYSTEM AND METHOD FOR A CONFORMABLE PRESSURE VESSEL

CROSS-REFERENCE TO RELATED APPLICATIONS

This application is a non-provisional of and claims priority to U.S. Provisional Patent Application No. 62/175,914 entitled SYSTEM AND METHOD FOR A CONFORMABLE PRESSURE VESSEL, filed Jun. 15, 2015, which is incorporated herein by reference in its entirety and for all purposes.

This application is related to U.S. Non-Provisional patent application Ser. No. 14/624,370 entitled COILED NATURAL GAS STORAGE SYSTEM AND METHOD, filed Feb. 17, 2015, which is incorporated herein by reference in its entirety and for all purposes.

This application is related to U.S. Non-Provisional patent application Ser. No. 14/172,831 entitled NATURAL GAS INTESTINE PACKED STORAGE TANK, filed Feb. 4, 2014, which is incorporated herein by reference in its entirety and for all purposes.

This application is related to U.S. Non-Provisional patent application Ser. No. 13/887,201 entitled CONFORMABLE NATURAL GAS STORAGE, filed May 3, 2013, which is incorporated herein by reference in its entirety and for all purposes.

This application is related to U.S. Provisional Patent Application No. 61/642,388 entitled CONFORMING ENERGY STORAGE, filed May 3, 2012, which is incorporated herein by reference in its entirety and for all purposes.

This application is related to U.S. Provisional Patent Application No. 61/766,394 entitled NATURAL GAS INTESTINE PACKED STORAGE TANK, filed Feb. 19, 2013 which is incorporated herein by reference in its entirety and for all purposes.

STATEMENT REGARDING FEDERALLY-SPONSORED RESEARCH

This invention was made with Government support under DE-AR0000255 awarded by the US DOE. The Government has certain rights in this invention.

BACKGROUND

Since the 1990's heavy vehicles have been taking advantage of compressed natural gas (CNG) engines. However, light vehicles, such as passenger cars, still have yet to achieve widespread adoption. Both private and public players began to identify technological hurdles to CNG passenger vehicle growth. Industry realized that if certain storage issues could be solved natural gas offered incredible untapped opportunity. However, current CNG storage solutions, both for integrated vehicles and converted vehicles, are still bulky and expensive cylinder based systems. For the integrated systems, various sized cylindrical tanks are integrated into the vehicle chassis design. For the converted vehicles, a big tank is placed in the trunk, eliminating storage or spare tires.

In view of the foregoing, a need exists for an improved fluid storage system and method in an effort to overcome the aforementioned obstacles and deficiencies of conventional fluid storage systems such as CNG storage systems, and the like.

Figure 1B:
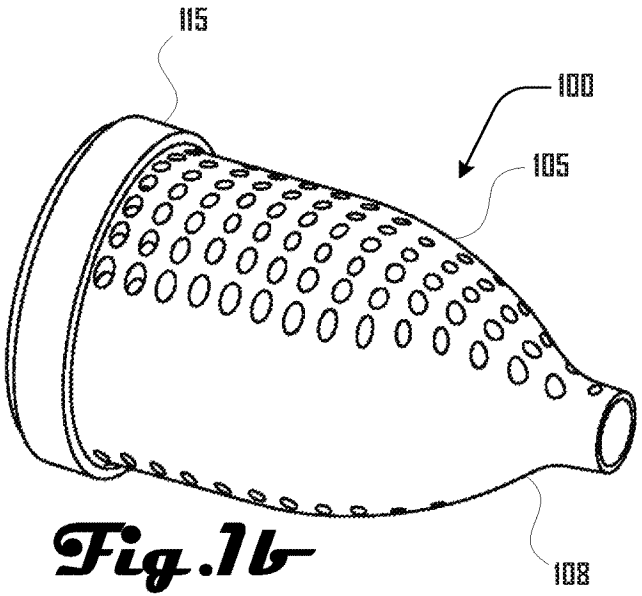
FIG. 1*b* is an exemplary perspective view illustrating an embodiment of the end cap of FIG. 1*a*.
Figure 1D:
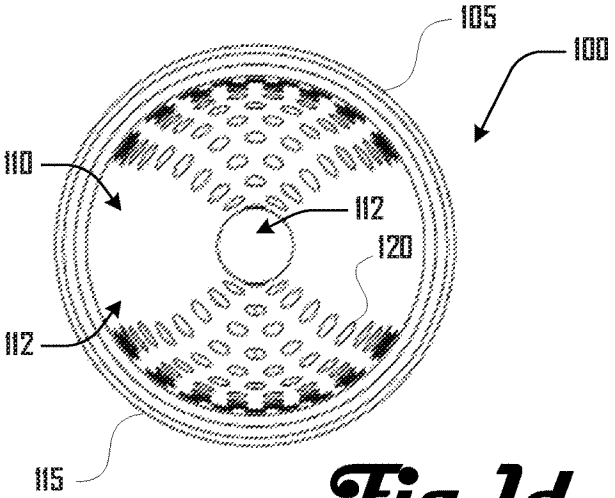
FIG. 1*d* is another exemplary side view illustrating an embodiment of the end cap of FIGS. 1*a-c*.
Figure 1A:
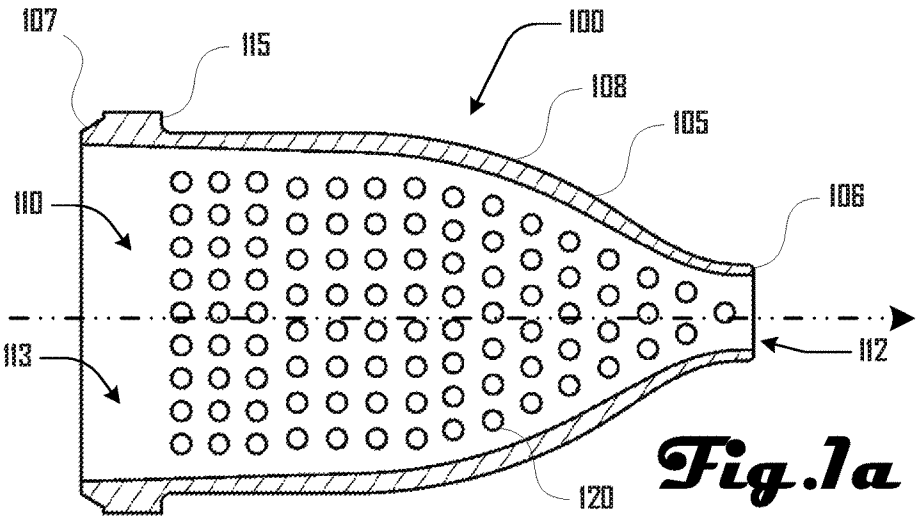
FIG. 1*a* is an exemplary cross-section view illustrating an embodiment of an end cap.
Figure 1C:
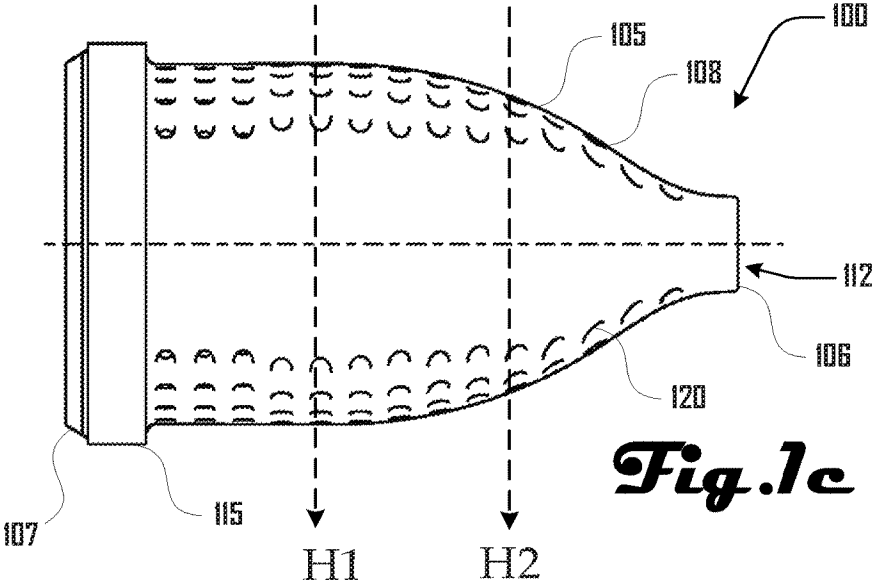
FIG. 1*c* is an exemplary side view illustrating an embodiment of the end cap of FIGS. 1*a* and 1*b*.

It should be noted that the figures are not drawn to scale and that elements of similar structures or functions are generally represented by like reference numerals for illustrative purposes throughout the figures. It also should be noted that the figures are only intended to facilitate the description of the preferred embodiments. The figures do not illustrate every aspect of the described embodiments and do not limit the scope of the present disclosure.

DETAILED DESCRIPTION OF THE PREFERRED EMBODIMENTS

Since currently-available fluid storage systems are deficient, a conformable pressure vessel that has high strength and durability with relatively low weight can prove desirable and provide a basis for a wide range of application, such as storing fluids such as CNG in cavities of various sizes, including in vehicles. This result can be achieved, according to various example embodiments disclosed herein, by the systems and methods for a conformable pressure vessel as illustrated in the figures and described herein.

Turning to FIGS. 1*a-d*, an end-cap 100 is shown as comprising a body 105 having first and second ends 106, 107 and defining a cavity 110. As shown in FIGS. 1*a-d*, the cavity 110 is open at the first and second end 106, 107, with the first end 106 defining a first opening 112 and the second end defining a second opening 113. The diameter of the second opening 113 can be larger than the diameter of the first opening 112, with the body 105 defining a taper 108 between the first and second end 106, 107. The second end 107 can comprise a rim 115 that surrounds the second opening 113.

In various embodiments, the body 105 can define a plurality of coupling holes 120 that extend between the cavity 110 and an external surface of the end cap 100. In some embodiments, pairs of coupling holes 120 can be aligned along a common axis (e.g., axis H1 or H2) and a portion of the coupling holes can be aligned along parallel axes (e.g., axis H1 and H2 are shown being parallel). However, in further embodiments, configurations of coupling holes can be in any suitable regular or irregular configuration. Additionally, in further embodiments, coupling holes 120 can be any suitable size and shape and may not extend completely through the body 105.

Figures 2A, 2B:
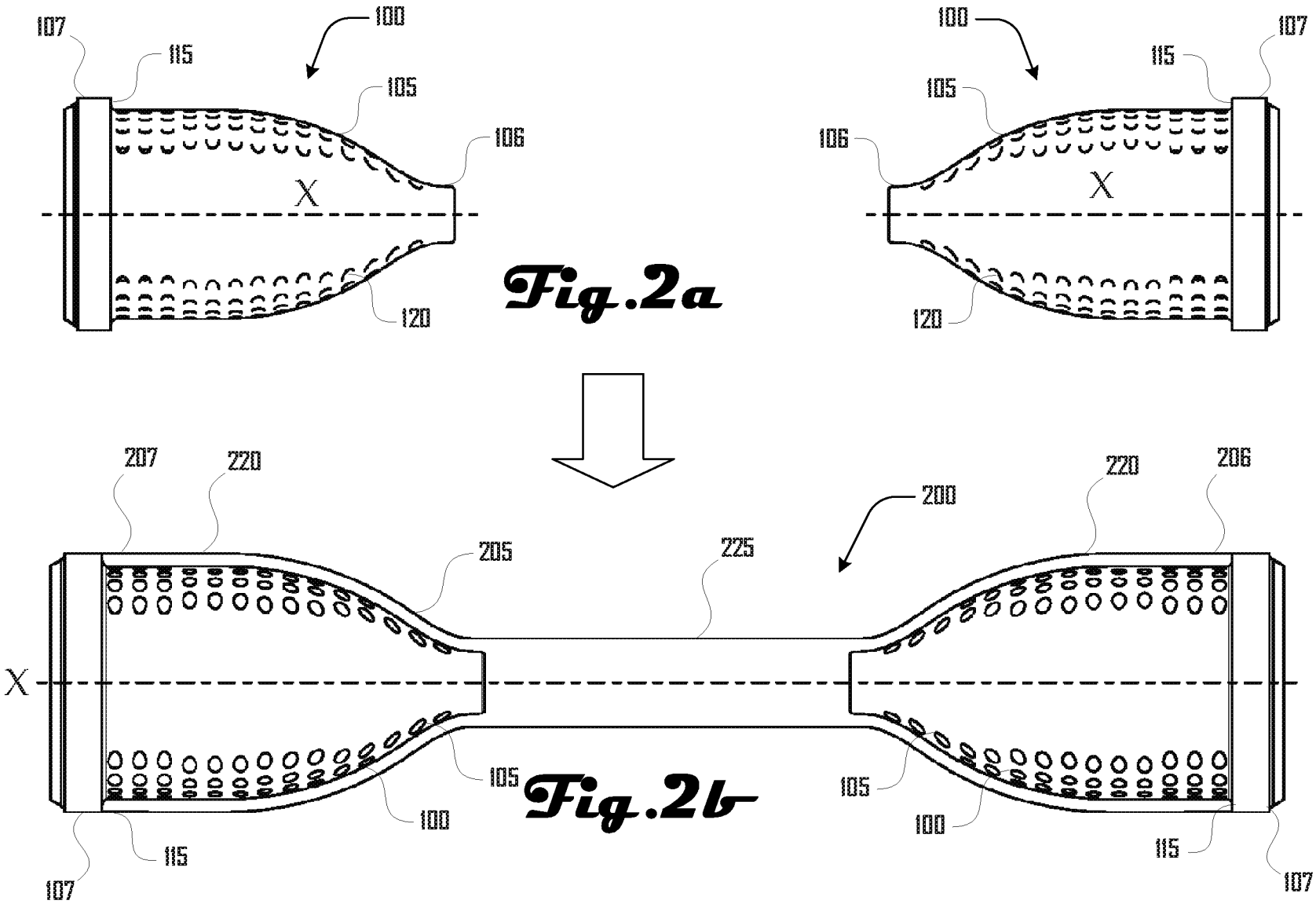
FIG. 2*a* illustrates a side view of a pair of end caps positioned facing each other and aligned along a common axis.
FIG. 2*b* illustrates a side view of a flexible connector comprising the pair of end caps of FIG. 2*a* and a flexible body that surrounds and couples the end caps.

Turning to FIGS. 2*a* and 2*b*, pairs of end caps 100 can be used to form a flexible connector 200. For example, FIG. 2*a* shows a pair of end caps 100 being positioned with respective first openings 112 facing and aligned along a common axis X.

Figures 3A, 3B:
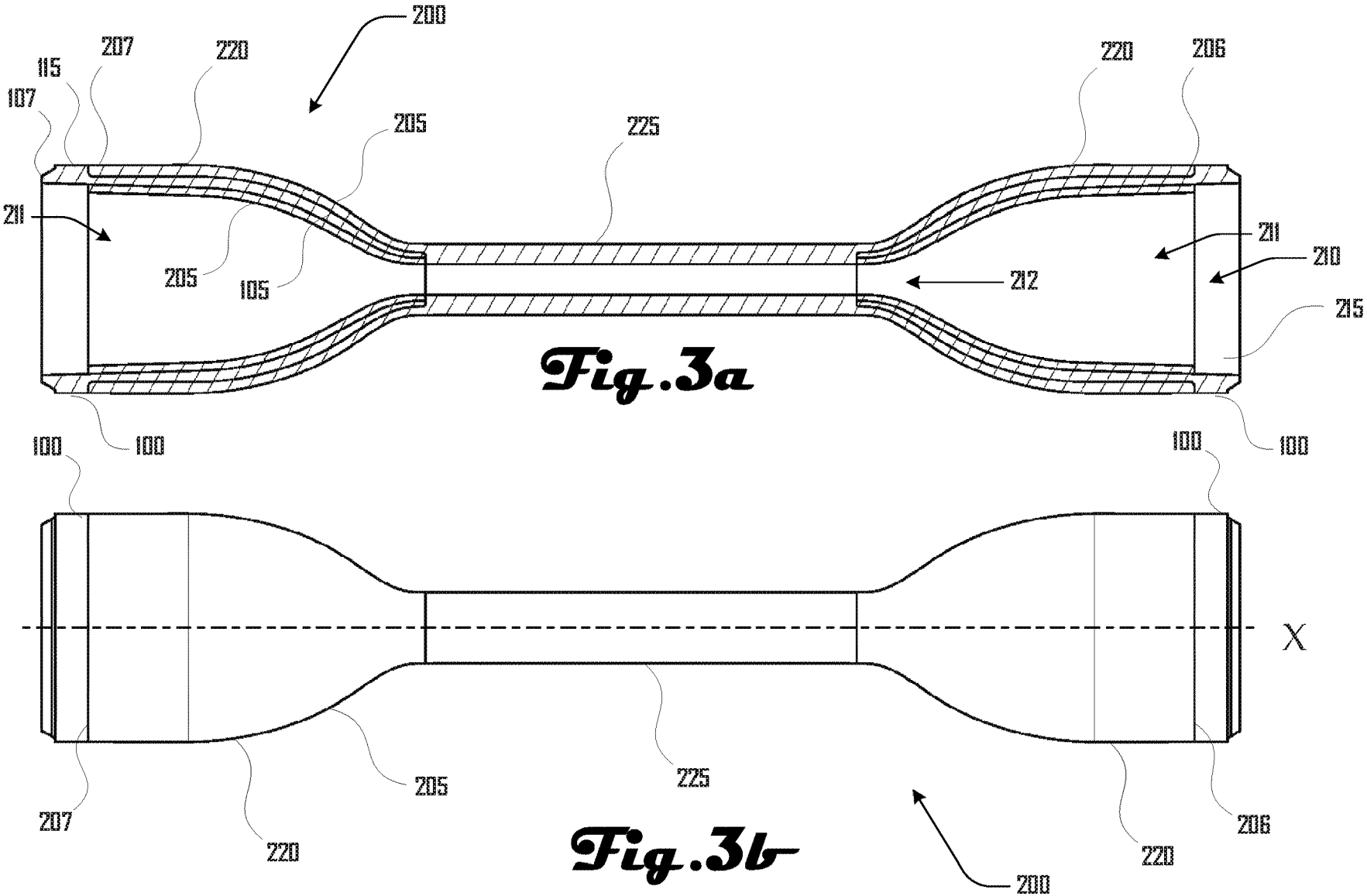
FIG. 3*a* illustrates a cross section view of the flexible connector of FIG. 2*b*.
FIG. 3*b* illustrates a side view of the flexible connector of FIG. 2*b*.

As illustrated in FIGS. 2*b*, 3*a* and 3*b* the end caps 100 can be surrounded by a flexible body 205 that extends between and couples the end caps 100. The flexible body 205 can comprise a first and second end 206, 207 that abut the rim 115 of the end caps 100 to form a pair of opposing heads 220 separated by an elongated central portion 225. As shown in FIG. 3*a*, the end cap bodies 105 and flexible body 205 can define an elongated connector cavity 210 that includes head cavities 211 defined by the heads 220 and a channel 212 defined by the central portion 225.

As shown in FIG. 3*a*, the flexible body 205 can cover internal and external portions of the end caps 100 such that a portion of the end caps 100 is sandwiched between portions of the flexible body 205. For example, in various embodiments, the ends caps 100 can be completely surrounded by the flexible body 205 aside from the second end 107 and rim 115 of the end caps 100, with the flexible body 205 lying flush with the rim 115. Additionally, in various embodiments, the flexible body 205 can extend through and substantially fill the coupling holes 120 (shown in FIGS. 1*a-d* and 2*a* and 2*b*). This may be desirable for providing a stronger coupling of the end caps 100 and the flexible body 205.

In further embodiments, the end caps 100 and flexible body 205 can be coupled in one or more suitable ways, including a mechanical coupling (e.g., threads, slot-and-pin), an adhesive, a weld (e.g., a laser weld), a wrapping, co-molding, or the like. In embodiments where a laser weld is used it may be desirable to select materials where a first material is transparent to the laser and a second material absorbs laser light. Accordingly, in some embodiments, end caps 100 can comprise a material or have an opacity that absorbs laser light and the flexible body 205 can comprise a material or have an opacity that is transparent to laser light.

Figure 4:
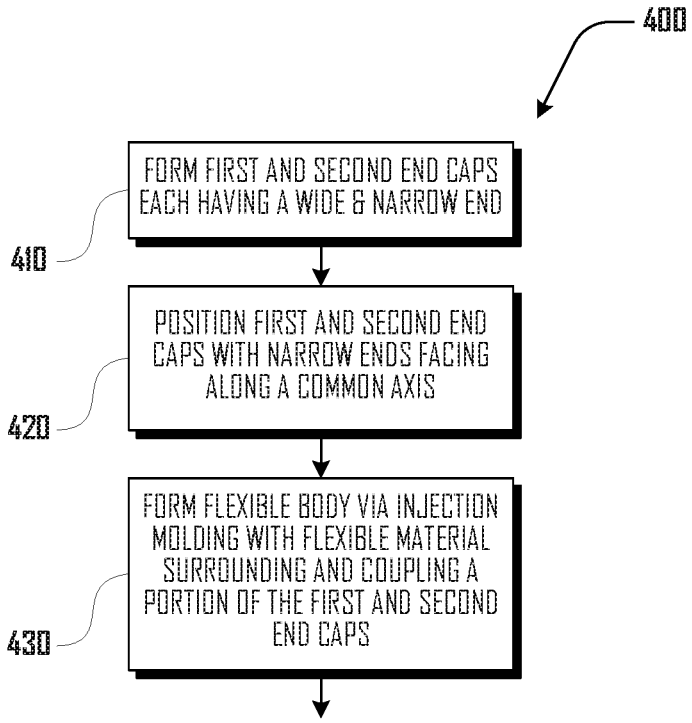
FIG. 4 illustrates a method of generating a flexible connector via injection molding.

The flexible connector 200 can be made in various suitable ways. For example, in some embodiments, portions of the flexible connector 200 can be made with injection molding, blow molding, compression molding, three-dimensional printing, milling, or the like. FIG. 4 illustrates one preferred embodiment of a method 400 of making a flexible connector. The method 400 begins in block 410 where first and second end caps 100 are formed, with each having a narrow end 106 and wide end 107 (e.g., as shown in FIGS. 1*a-c* and 2*a* and 2*b*).

In block 420, the first and second end caps 100 are positioned with the narrow ends 106 facing each other and aligned on a common axis X (e.g., as shown in FIG. 2*a*). In block 430 a flexible body 205 is formed via injection molding with the flexible body 205 surrounding and coupling the end caps 100 (e.g., as shown in FIGS. 2*b*, 3*a* and 3*b*).

The end caps 100 and flexible body 205 can be made of any suitable materials. In some embodiments, the end caps 100 are rigid and the flexible body 205 is substantially more flexible than the end caps 100. In various embodiments, the materials for the end caps 100 and flexible body 205 can be selected based on their flexibility, rigidity, ability to couple or bond with each other, ability to couple or bond with other materials, fluid permeability, and the like. For example, in some embodiments, the end caps 100 can comprise Nylon, High Density Polyethylene (HDPE), ethylene-vinyl acetate, linear low-density polyethylene (LLDPE), ethylene vinyl alcohol (EVOH), polyurethane, or the like. The flexible body 205 can be made of various suitable materials including flexible plastics, ethylene-vinyl acetate, thermoplastic urethane, butyl rubber, and the like.

Figures 5A, 5B, 5C, 5D:
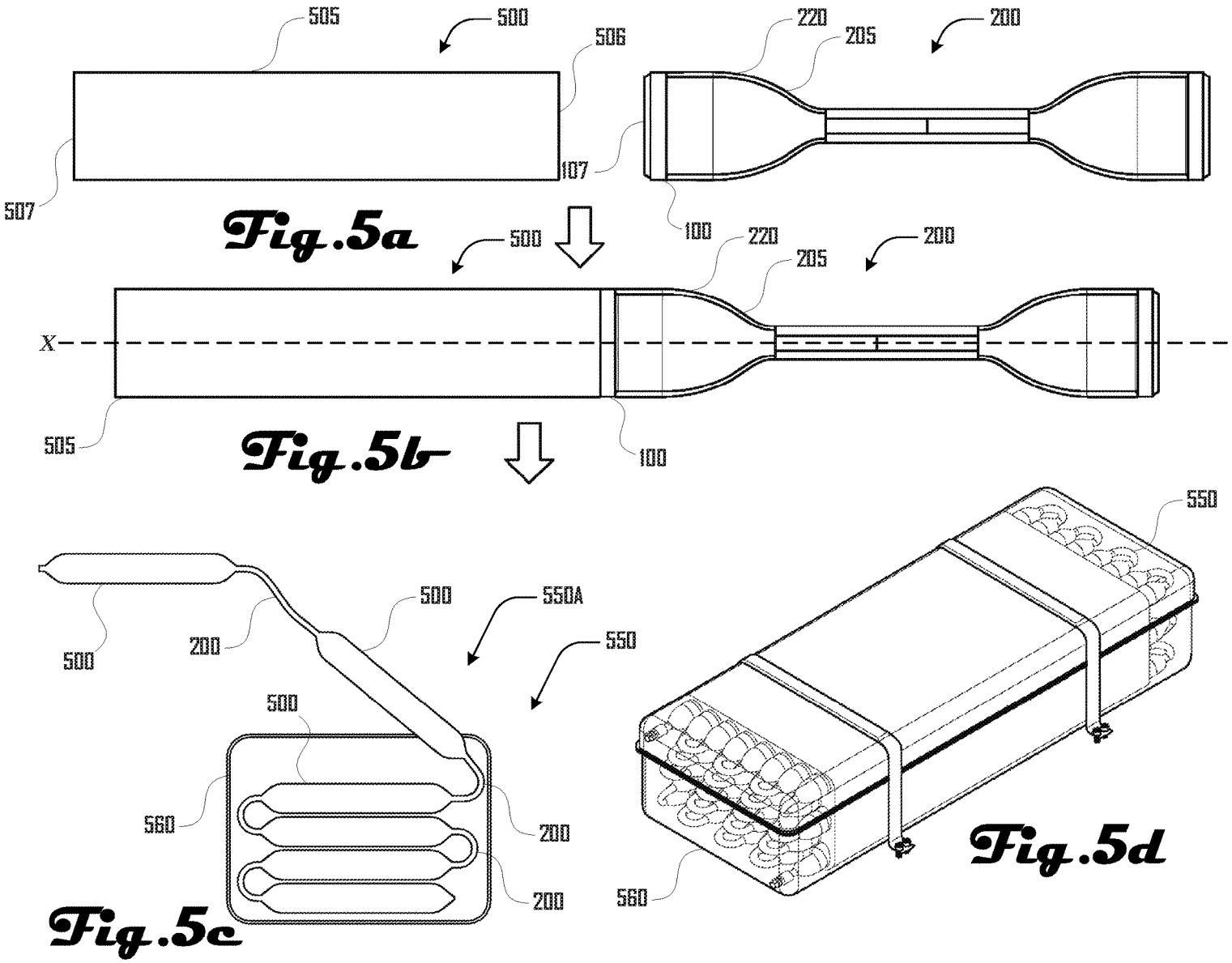
FIG. 5*a* illustrates an embodiment of tubing and the flexible connector of FIGS. 2*b*, 3*a* and 3*b*.
FIG. 5*b* illustrates the tubing and flexible connector of FIG. 5*a* coupled at respective ends.
FIG. 5*c* illustrates a liner being folded into a housing in accordance with one embodiment.
FIG. 5*d* illustrates a liner folded in a housing in accordance with another embodiment.
Figure 6A:
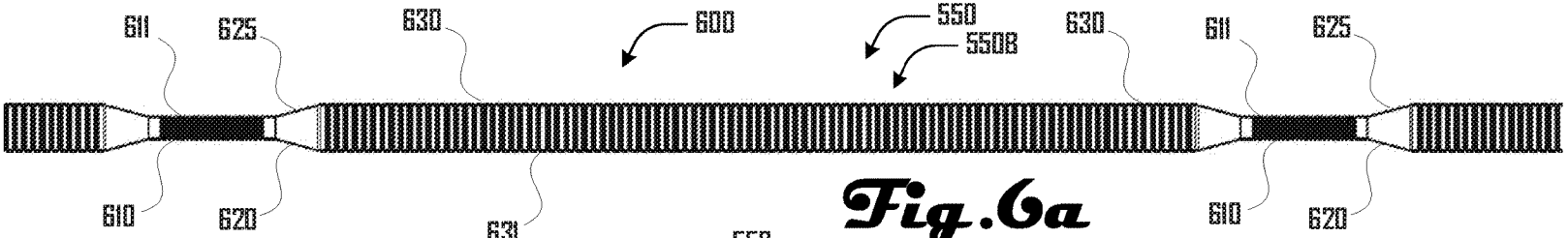
FIG. 6*a* illustrates a cross section view of a portion of a corrugated liner in accordance with one embodiment.
Figure 6B:
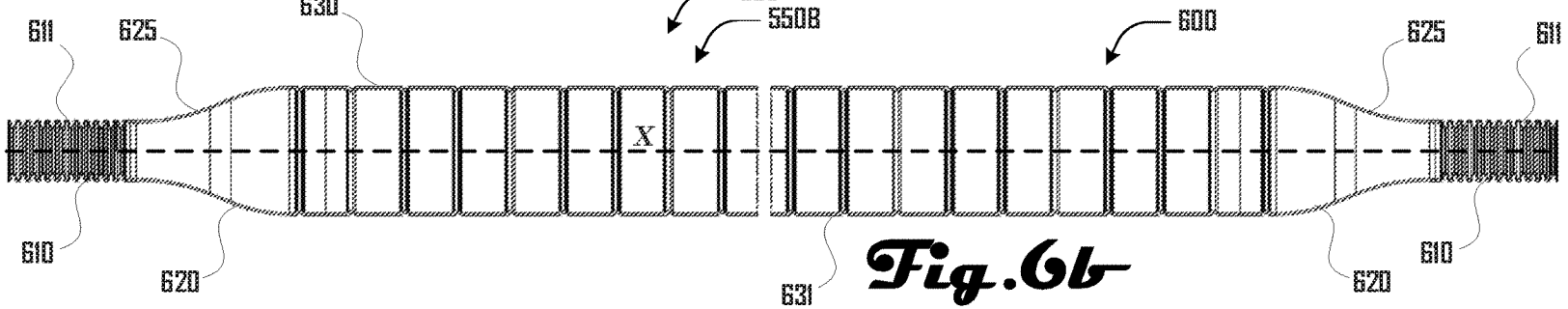
FIG. 6*b* illustrates a side view of the corrugated liner portion of FIG. 6*a*.
Figure 6D:
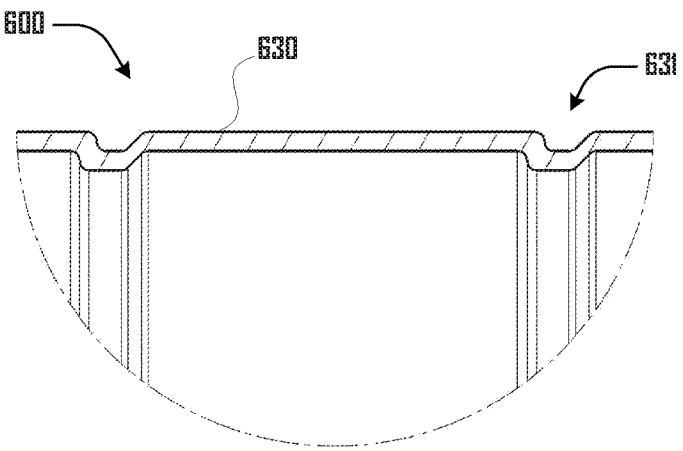
FIG. 6*d* illustrates a side view of a corrugated liner in accordance with another embodiment.
Figure 6C:
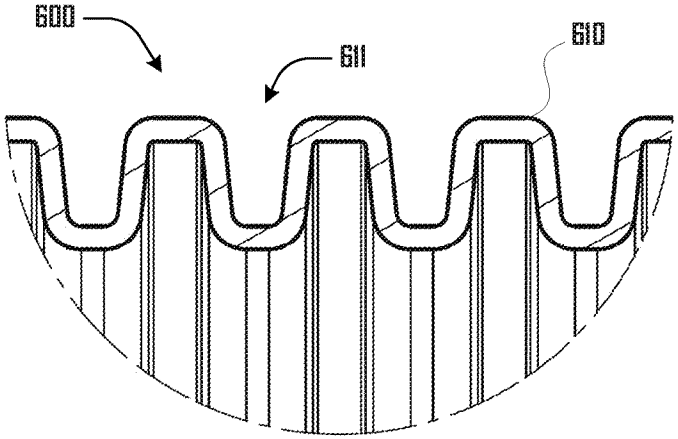
FIG. 6*c* illustrates a perspective view of a corrugated liner in accordance with one embodiment.

Turning to FIGS. 5*a-d*, flexible connectors 200 can be coupled with tubing 500 to define a liner 550A, which can be folded into a housing 560 as illustrated in FIGS. 5*c* and 5*d*. For example, FIGS. 5*a* and 5*b* illustrate the second end 107 of an end cap 100 being coupled with a first end 506 of tubing 500 that also comprises a body 505 and a second end 507. The tubing 500 can comprise any suitable material. In various embodiments, the tubing 500 is rigid.

In some embodiments, tubing 500 can comprise Nylon, High Density Polyethylene (HDPE), ethylene-vinyl acetate, linear low-density polyethylene (LLDPE), ethylene vinyl alcohol (EVOH), polyurethane, or the like. In one preferred embodiment, the end caps 100 can comprise Nylon 6 (PA6). In various embodiments, the end caps 100 and tubing 500 can comprise the same material or the material of end caps 100 and tubing 500 can be chosen based on compatibility for bonding, welding, coupling, and the like.

FIGS. 5*a* and 5*b* illustrate one example embodiment where the end cap 100 and tubing 500 is coupled via welding. However, in further embodiments, a flexible connector 200 can be coupled with the tubing 500 via any suitable method including one or more of a mechanical coupling (e.g., threads, slot-and-pin), an adhesive, a weld (e.g., a laser weld), a wrapping, co-molding, or the like.

Figure 14A:
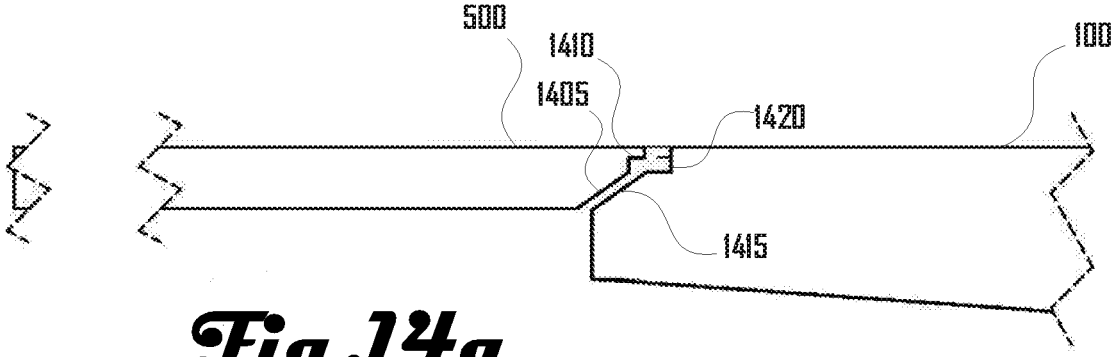
FIGS. 14*a* and 14*b* illustrate a close-up cross section view of the chamfer at the end of an end cap and tubing in accordance with one embodiment.
Figure 14B:
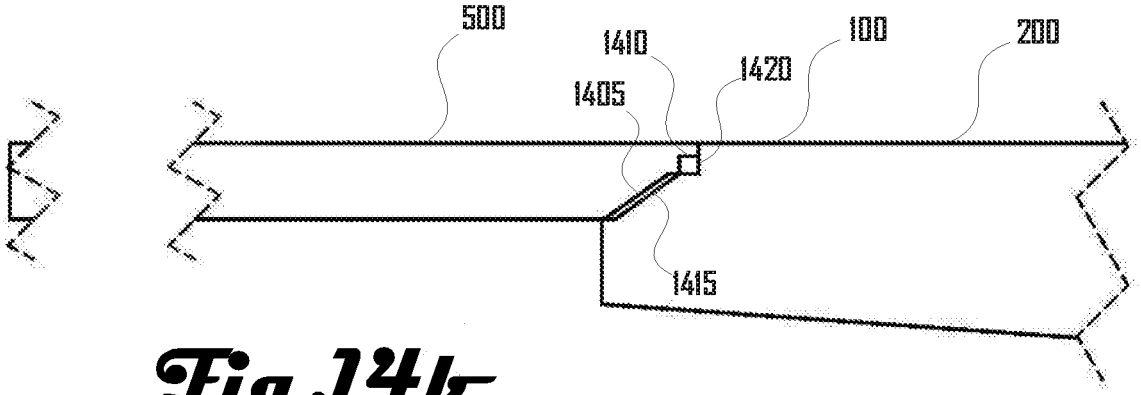
Figure 15C:
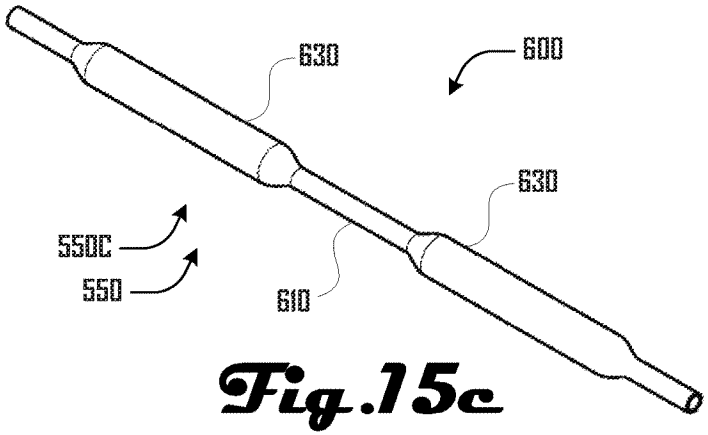
FIG. 15*c* illustrates a close-up cross sectional view of a connector portion having corrugations.
Figure 15A:
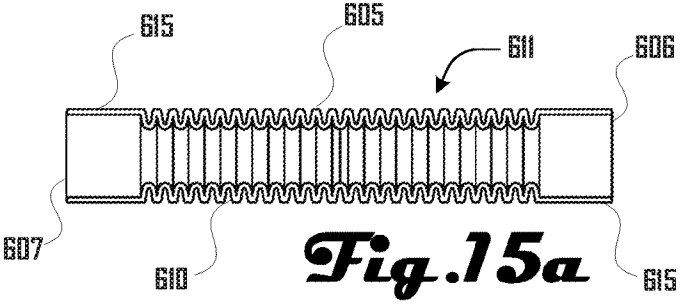
FIGS. 15*a* and 15*b* illustrate a first and second side view of another embodiment of a corrugated liner.
Figure 15B:
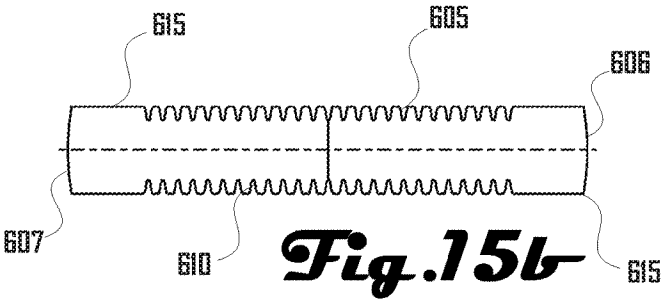
Figure 15D:
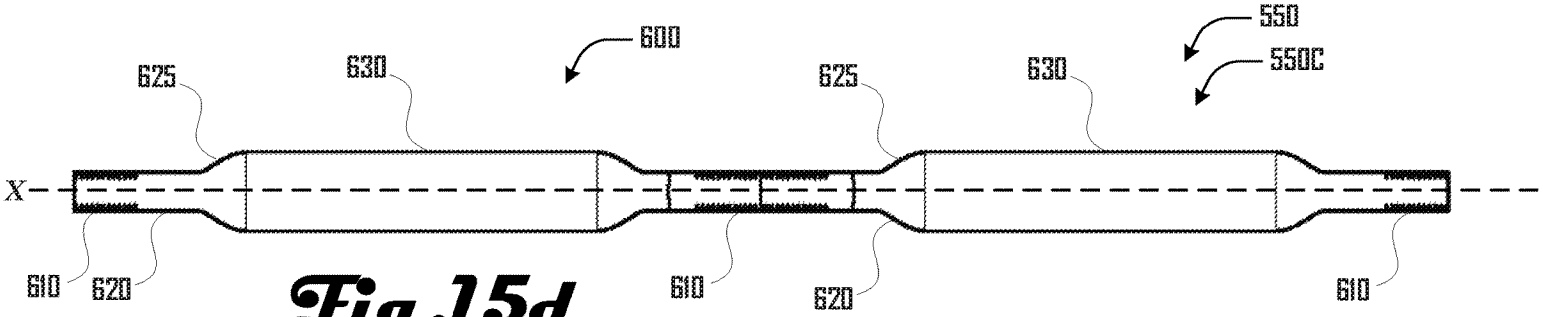
FIG. 15*d* illustrates a close-up cross sectional view of a tubing portion having corrugations.

In various embodiments, the end cap 100 and tubing 500 can be shaped to improve coupling. In some embodiments, a chamfer at the end of the end cap 100 and tubing 500 can substantially improve the coupling generated by a laser weld, or the like. One example embodiment is shown in FIGS. 14*a* and 14*b*, where FIG. 14*a* illustrates the end cap 100 and tubing 500 before a weld and FIG. 14*b* illustrates the end cap 100 and tubing 500 after a weld. FIGS. 14*a* and 14*b* illustrate the tubing 500 comprising a chamfer having an angled portion 1405 and a notch portion 1410. The end cap 100 comprises a corresponding chamfer having an angled portion 1415 and a notch portion 1420. Although the chamfer of FIGS. 14*a* and 14*b* has been shown to provide a stronger laser weld than other configurations because it provides for axial pushing to generate force in the radial direction (i.e., perpendicular to the weld surface), other variations of a chamfer can be used in further embodiments.

As illustrated in FIGS. 5*c* and 5*d*, the flexible connectors 200 can be flexible and the tubing 500 can be rigid such that a liner 550 having alternating sections of flexible connectors 200 and tubing 500 can be folded to conform to the shape of a housing 560. Although FIGS. 5*c* and 5*d* illustrate an embodiment wherein the flexible connectors 200 and tubing 500 each have a consistent length, in further embodiments, one or both of the flexible connectors 200 and tubing 500 of a liner 550 can be different lengths.

Although a liner 550 can comprise flexible connectors 200 and tubing 500 as illustrated in FIGS. 5*a-d*, a liner 550 can be made in various suitable ways in accordance with further embodiments. For example, FIGS. 6*a-d* and 15*a-d* illustrate further embodiments 550B, 550C of a liner 550 that comprises a body 605 having connector portions 610, taper portions 625 and tubing portions 630. The connector portion 610 can comprise connector corrugations 611, which can allow the connector portion 610 to be flexible such that the liner 550B can be folded into a housing 560 as illustrated in FIGS. 5*c* and 5*d*. Similarly, in some embodiments (e.g., as illustrated in FIGS. 6*a-d*), the tubing portions 630 can comprise corrugations 631. However, in further embodiments, the corrugations 631 can be absent from the tubing portions (e.g., as illustrated in FIGS. 6*a-d*). Non-corrugated portions 620 can be rigid in various embodiments.

In various embodiments, the connector portion 610 can have a diameter that is smaller than the tubing portions 630, with the taper portion 625 providing a transition between the diameter of the connector portion 610 and the tubing portion 630. However, further embodiments can comprise a liner 550 with portions having one or more suitable diameter and in further embodiments, a liner 550 can have portions that are non-cylindrical, which can include various suitable shapes.

In some embodiments, a corrugated liner 550B can be made by forming various pieces of the liner 550B and then coupling the pieces together. For example, connector portion 610 can be manufactured separately from the taper portion 625 and/or the tubing portion 630. Such separate portions can be subsequently coupled together to form the liner 550B.

Figure 7A:
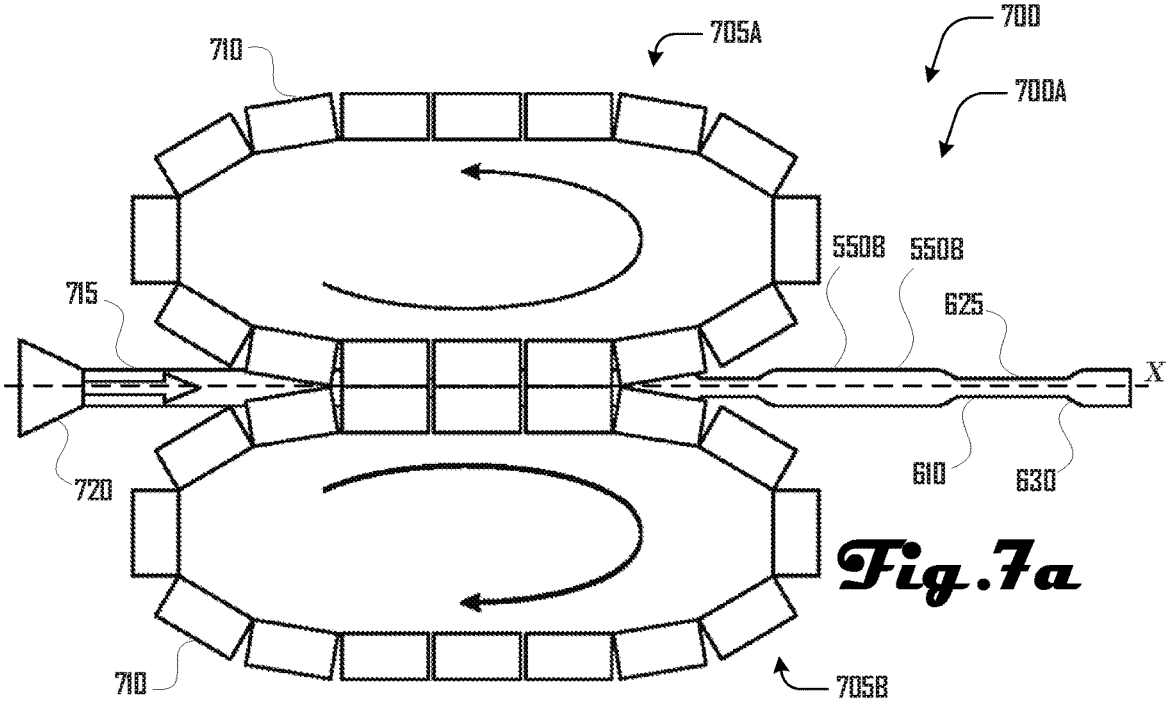
FIGS. 7*a* and 7*b* illustrate embodiments of an extrusion molding apparatus for making a liner.
Figure 7B:
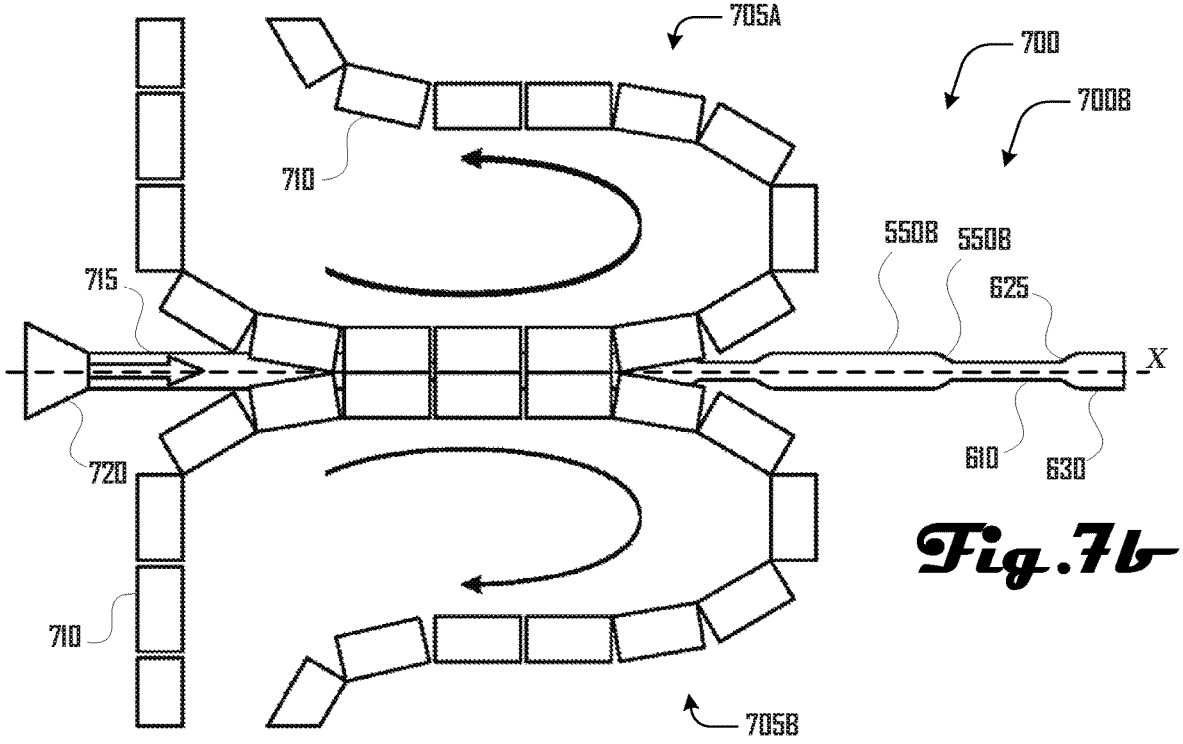

However, in one embodiment, the liner 550B can be generated via extrusion molding systems 700 shown in FIGS. 7*a* and 7*b*, which can comprise first and second sets 705A, 705B of rotating dies 710 that are configured to rotate in concert such that corresponding dies 710 mate about an extruded tube 715 generated by an extruder 720. Corresponding mated dies 710 can define one or more of the connector portion 610, taper portion 625 and/or the tubing portion 630.

In various embodiments, a vacuum can pull the material of the extruded tube 720 to conform to negative contours defined by the mated dies 710. In various embodiments, such a manufacturing process can be beneficial because liners 550B can be made seamlessly, with no welds, and using a single material.

In some embodiments, liners 550 having varying lengths of the connector portion 610, taper portion 625 and/or the tubing portion 630, can be made by selectively choosing the order of dies 710 such that desired portions are made longer or shorter. For example, FIG. 7*b* illustrates and embodiment of a system 700B where dies 710 can be selectively introduced to the sets 705A, 705B. In contrast, FIG. 7*a* illustrates and embodiment of a system 700A where dies 710 remain constant within the sets 705A, 705B.

As illustrated in FIGS. 7*a* and 7*b*, a rotary corrugation machine 700 can comprise two tracks 705 of rotating dies 710, where each track 705 holds dies 710 with one half of the tube geometry. Tracks can be positioned relative to each other such that for a brief period both sides of the track 705 come in contact, and corresponding die halves 710 are aligned to form a complete negative of the desired tubing geometry.

After making contact for a required period of time, die halves 710 separate and rotate back through the track 705. Some embodiments can be loaded with a fixed number and order of dies 710 as illustrated in FIG. 7*a*, which can be desirable for a liner 550 that comprises a continuously repeating pattern.

However, in some embodiments, it can be desirable to form a liner 550 that has varying lengths of the tubing portion 630 and/or connector portion 610. For example, in some embodiments, a liner 550 can be produced that fits into an irregular or non-rectangular cavity, which can require a liner 550 to have tubing portions 630 of variable lengths.

Accordingly, as illustrated in FIG. 7*b*, in some embodiments, dies 710 can be selectively added and removed from the rotating sets 705 so that corrugated tubing 550 that has varying lengths of the tubing portion 630 and/or connector portion 610 can be generated. In various embodiments, dies 710 can be removed or added at any point before or after the period which die halves 710 are in contact. Various embodiments can comprise a mechanism to remove dies 710 from the track 705 and reload these dies 710 into an appropriate hopper or storage area, and a mechanism to move desired dies 710 from a hopper into position on the corrugation line 705. Further embodiments can include any suitable mechanism for removing and adding dies 710 to the set of rotating dies 705. Additionally, in various embodiments, the rotary corrugation machine 700B can be configured to generate the same order of dies 710 for both tracks 705 so that when the dies 710 come together, such dies 710 are corresponding and generate the desired portion of the liner 550.

Further embodiments can comprise a shuttle corrugation machine (not shown) for generating a liner 550. In such embodiments, corresponding mold halves are aligned for a period of time to form tubing geometry. However instead of each mold half being coupled to the adjacent mold path, and being continuously rotated to return mold halves, a shuttle corrugation machine can use a linear rail return system. In this system, individual molds can be decoupled once molds have reached the ends of the track, and the molds can be separated and returned to the beginning of the corrugation line by way of linear rail. In such embodiments, various suitable mechanisms for interchanging dies on a shuttle corrugator can be used, including mechanisms similar to those discussed above.

In further embodiments, liners 550 can be made in any suitable way. For example, in one embodiment, portions of a liner 550 can be formed via blow-molding, rotational molding, injection-overmolding, or the like. In such embodiments, formed portions of the liner 550 can be assembled via any suitable method, including welding, an adhesive, or the like. One embodiment can comprise injection-overmolding of rotationally molded chambers, which can be desirable because some implementations of such a method can eliminate the need for a welded joint. Another embodiment can comprise hourglass connectors, with overmolded metal smaller diameter tubing. A further embodiment can comprise smaller diameter metal tubing rotationally overmolded with individual chambers (i.e., large diameter and taper). One embodiment can comprise swaging straight plastic or metallic extrusions to generate a taper and a small diameter. Another embodiment can comprise necked down straight plastic tubing to form variable diameter plastic tubing.

A still further embodiment can comprise a continuous liner made by hydroforming an elastomer. Such an embodiment can be generated in a heated closed mold process, at room temperature without a mold, or the like. Yet another embodiment can comprise continuous variable diameter extrusion, heat forming, or the like. In such an embodiment, after extrusion of tank geometry the liner 550 can be bent into final configuration via a method comprising heat forming bends.

In some embodiments, it can be desirable to generate a liner 550 in a vertical configuration. In other words, a manufacturing method can including forming the liner 550 with the main axis of the liner 550 being parallel to gravity during such forming. In some embodiments, such a manufacturing configuration can be desirable for reducing gravity induced sagging of the liner 550 that can be generated in non-vertical manufacturing. For example, in some non-vertical manufacturing, the liner 550 can be thicker on a lower half due to gravity pulling non-solid material downward.

Additionally, although example configurations of a liner 550 are shown and described herein, these examples should not be construed to be limiting on the wide variety of liners 550 that are within the scope and spirit of the present disclosure. For example, some embodiments can comprise asymmetric corrugations and/or asymmetric tapers. In further embodiments the geometry of a liner 550 can be configured for desirable flow of a fluid through the liner 550, and such a configuration can be determined based on computational fluid dynamics calculations, analytical flow calculations, experimental tests, or the like.

In various embodiments, it can be desirable for portions of the liner 550 to not buckle when bent. For example, in some embodiments, corrugations can be included in a liner 550 as illustrated in FIGS. 6*a*-6*d*. In further embodiments, a non-corrugated thick-walled elastomer can be used (e.g., having the geometry shown in FIGS. 2*b*, 3*a* and 3*b*). Additionally, in various embodiments, it can be desirable to provide for bending and reversible bending of the liner 550.

In some embodiments, it can be desirable to design the liner 550 so that it will deform in a predictable manner under internal pressure and/or an external constraint (e.g., a braid, filament winding, or the like, as discussed in more detail herein). In further embodiments, the liner 550 can be configured to operate at, and maintain integrity at, a wide range of temperatures, including −80° C. to +40° C.; −100° C. to +80° C.; and the like. In still further embodiments, the liner 550 can be designed to provide desirable thermal conductivity and/or to not be substantially susceptible to failure by electrostatic discharge after many cycles of filling and emptying with a fluid.

Although some preferred embodiments can be configured for storages of a fluid comprising CNG, further embodiments can be configured to store any suitable gas and/or liquid fluid, which may or may not be stored under pressure. For example, fluids such as natural gas, hydrogen, helium, dimethyl ether, liquefied petroleum gas, xenon, and the like can be stored. Additionally, such fluids can be stored at various suitable temperatures including room temperature, cryogenic temperatures, high temperatures, or the like.

In various embodiments, it can be desirable to cover a liner 550 with a braid and/or filament winding. For example, covering a liner 550 with a braid and/or filament winding can be desirable because the braid and/or filament winding can substantially increase the strength of the liner 550 without substantially increasing the weight and size of the liner 550. Braiding and/or a filament can be applied wet or dry in some embodiments.

Figure 8:
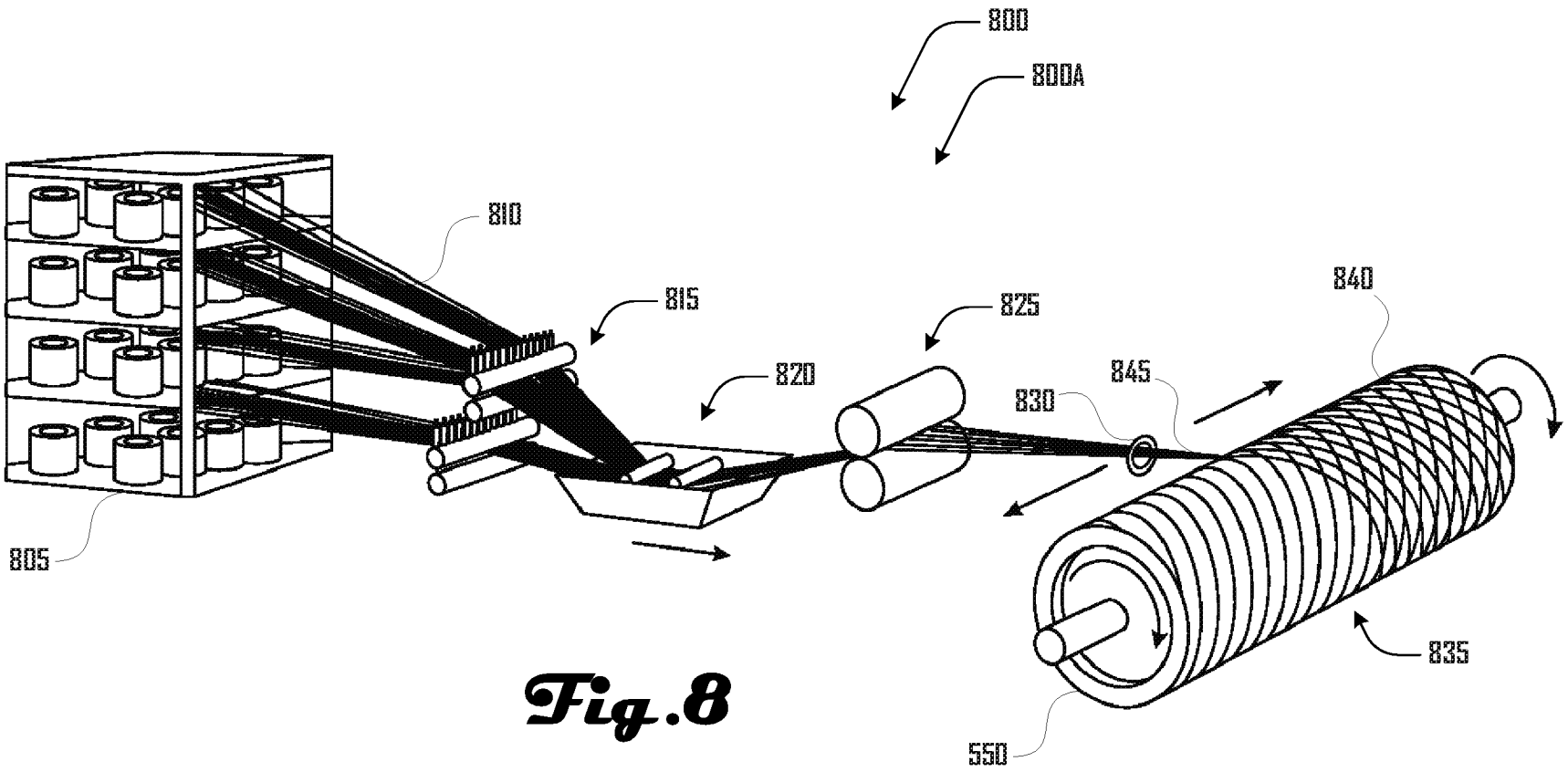
FIG. 8 illustrates an embodiment of a filament winding apparatus for applying a filament winding to a liner.

For example, FIG. 8 illustrates one embodiment 800A of a filament winding system 800 that comprises wet application of a filament covering 840 comprising a resin. Continuous rovings 810 originate from a creel 805 and pass through separator combs 815, into a resin bath 820 and through nip rollers 825. The rovings 810 are combined into a single line 845 and a translating guide 830 generates a filament covering 840 on the liner 550, which is disposed on a rotating mandrel 835.

Figure 9A:
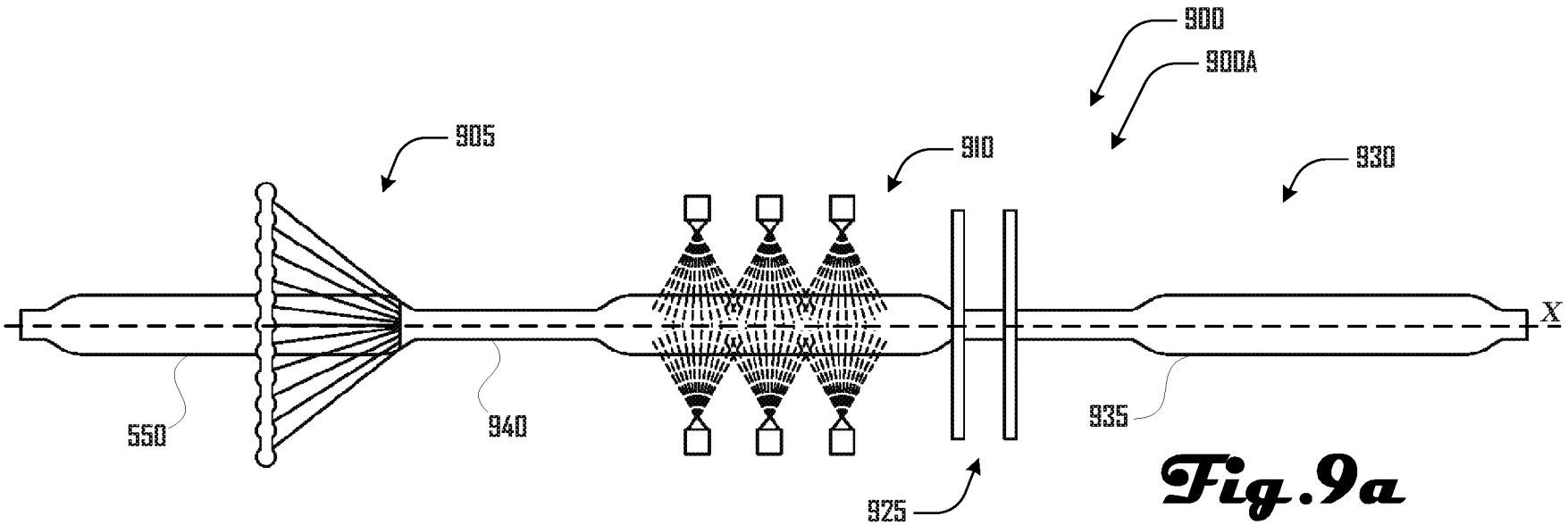
FIG. 9*a* illustrates a liner treating system in accordance with one embodiment.
Figure 9B:
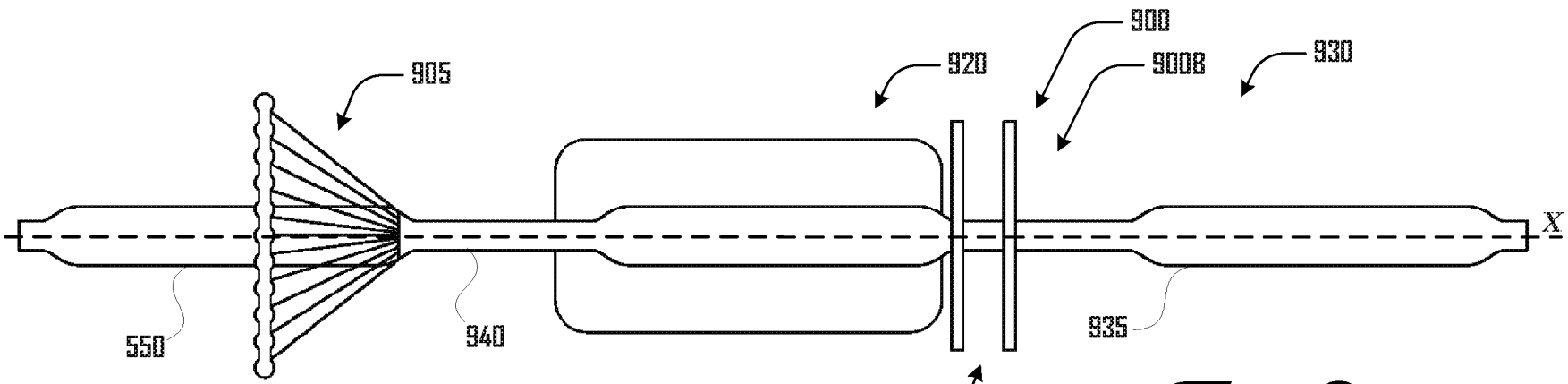
FIG. 9*b* illustrates another liner treating system in accordance with another embodiment.

In some embodiments, it can be desirable to apply a dry braid 940 to the liner 550, and apply resin to the braid 940 thereafter. For example, FIGS. 9*a* and 9*b* illustrate example embodiments 900A, 900B of systems 900 that are configured to apply a braid 940 to a liner 550 via a braiding machine 800 and apply resin to the braid 940. In various embodiments a die and/or squeegee assembly can be applied to the liner 550 to control the amount of resin that is absorbed into the braid 940. A winding of tape 935 can be applied via a taping apparatus 930. In some embodiments, resin can be applied via a resin-spray assembly 910 or a resin bath 920.

In some embodiments, a braid 940 can be applied to the liner 550 alternatively and/or in addition to a filament covering 940. In such an embodiment, a braiding machine 905 can replace the filament winding machine 800 and/or be included in addition to a filament winding machine 800, or vice versa. Additionally, although FIGS. 8, 9*a* and 9*b* illustrate a braid and resin being applied to a liner 550 in separate steps, in further embodiments, a braid and resin can be applied in the same step. For example, resin can be applied directly at a braiding location in various embodiments.

Before the resin cures or hardens, the liner 550 can be folded into a housing 560 (see FIGS. 5*c* and 5*d*) where the resin can cure or harden. In some embodiments, the resin can cure over time, can be cured via heat, can be cured by drying, can be cured via light, or the like. In various embodiments, it can be desirable to have the hardened folded liner 550 in the housing 560 so that the liner 550 becomes rigid and more resistant to failure due to movement and to increase the strength and durability of the liner 550. In further embodiments, a resin can cure or dry and remain flexible. Accordingly, in such embodiments, the liner 550 can be folded before or after curing or drying of such a flexible resin. Various suitable types of resins, or the like, can be used in various embodiments. For example, a resin can comprise one or more of an epoxy resin, a vinylester resin, a polyester resin, urethane, or the like.

Various suitable materials can be used to generate a braid and/or filament winding, including one or more of carbon fibers, aramid fibers (e.g., Kevlar, Technora, Twaron, and the like), Spectra fiber, Certran fiber, polyester fiber, nylon fiber, a metal, and the like. In one preferred embodiment, a thermoplastic fiber (e.g., Nylon) can be commingled with a carbon fiber.

Figure 17A:
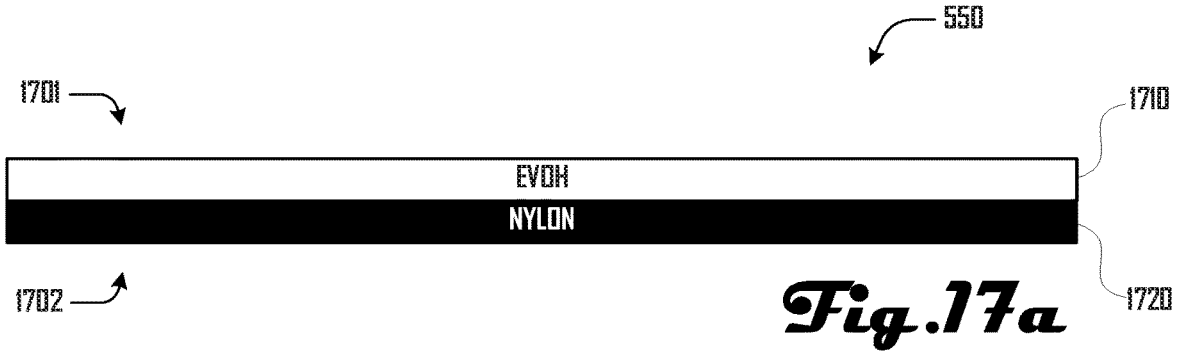
FIGS. 17*a*, 17*b*, 17*c* and 17*d* illustrate different embodiments of a multi-layer liner in accordance with some embodiments.
Figure 17B:
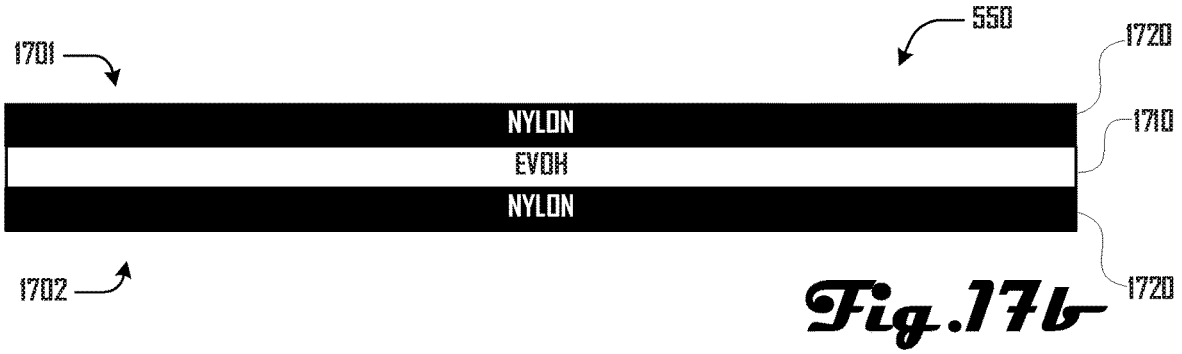
Figure 17C:
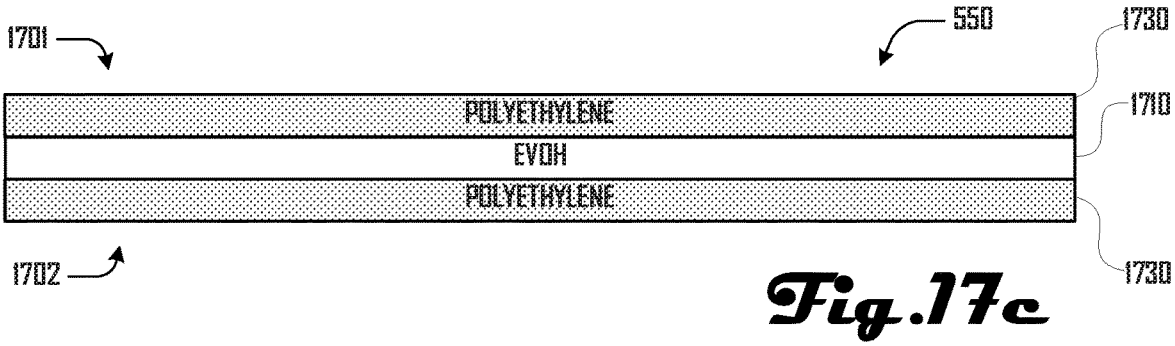

Another embodiment can comprise a multilayer polymer and/or metal. For example, such a liner can be generated via vapor deposition, multilayer extrusion or molding, or the like. FIGS. 17*a*, 17*b*, 17*c* and 17*d* illustrate example embodiments of a multilayer liner 550. For example, FIG. 17*a* illustrates a liner 550 having an EVOH layer 1710 and a nylon layer 1720. FIG. 17*b* illustrates a liner 550 having an EVOH layer 1710 between a first and second nylon layer 1720. FIG. 17*c* illustrates a liner 550 having an EVOH layer 1710 between a first and second polyethylene layer 1730.

Figure 17D:
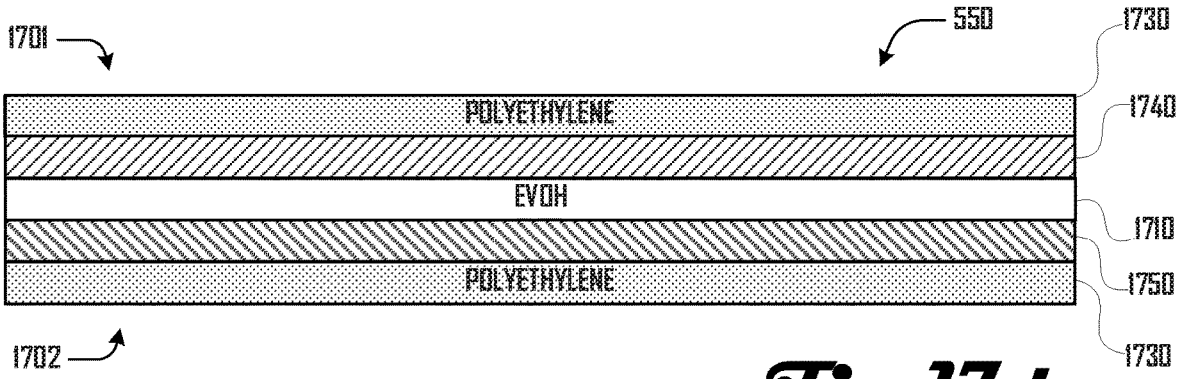

FIG. 17*d* illustrates a liner 550 having (starting at the first side 1701) a polyethylene layer 1730, a first material layer 1740, an EVOH layer 1710, a second material layer 1750, and a polyethylene layer 1730. The first and second materials 1740, 1750 can be any suitable materials including any suitable material discussed herein. In some embodiments, the first and second materials 1740, 1750 can be different materials or can be the same material.

In various embodiments a liner 550 can comprise or consist of any suitable number of layers including one, two, three, four, five, six, seven, eight, nine, ten, or the like. Some layers can comprise the same material in some embodiments, whereas in some embodiments, each of the layers can comprise different materials. In some embodiments (e.g., 17*b* and 17*c*), the liner 550 can comprise a symmetrical material layer portion, whereas in other embodiments, the liner 550 can be without a symmetrical layer portion.

In FIGS. 17*a-d* the liner 550 is shown having a first and second side 1701, 1702. In some embodiments, the first side 1701 can be an externally facing side facing away from an internal cavity of the liner 550. Alternatively, in some embodiments, the first side 1701 can be an internally facing side of the liner 550 wherein the first side faces an internal cavity of the liner 550. In other words, the example layering of FIG. 17*a* can illustrate a liner having an internal EVOH layer 1701 or an external EVOH layer.

Additionally, further embodiments of a liner 550 can comprise further layers and/or materials than shown in FIGS. 17*a-d*. For example, some embodiments can comprise one or more braided layer that covers an external face of the liner 550 as discussed herein. Also, in some embodiments, material layers of a liner 550 can be coupled via an adhesive. For example, referring to FIG. 17*c*, an adhesive layer can be present between the EVOH layer 1710 and the respective polyethylene layers 1730.

Although FIGS. 17*a-d* illustrate example embodiments of a liner 550 comprising EVOH, nylon and/or polyethylene in two or three layers, this should not be construed to be limiting on the wide variety of materials that can be used in a multi-layer configuration. Accordingly, in further embodiments, any suitable material, including any suitable materials discussed herein, can be layered with a first and second material that are different materials as shown in FIG. 17*a* or with a first material that sandwiches a second material as shown in FIGS. 17*b* and 17*c*.

Figure 10:
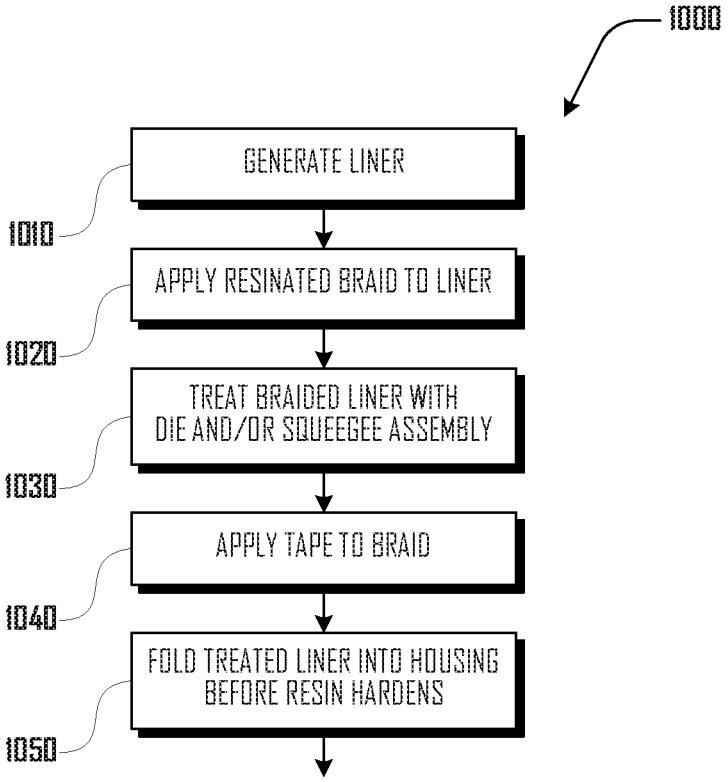
FIG. 10 illustrates a method of making a treated liner in accordance with one embodiment.

FIG. 10 illustrates a method 1000 of generating a treated liner in accordance with an embodiment. The method 1000 begins in block 1010, where the liner 550 is generated, and in block 1020, a resinated braid (and/or filament covering) is applied to the liner 550. In block 1030 the braid is treated with a die and/or squeegee assembly, and in block 1040, tape is applied to the braid. In block 1050, the treated liner is folded into a housing 560 before the resin hardens or cures or before the resin is hardened or cured.

Figure 11:
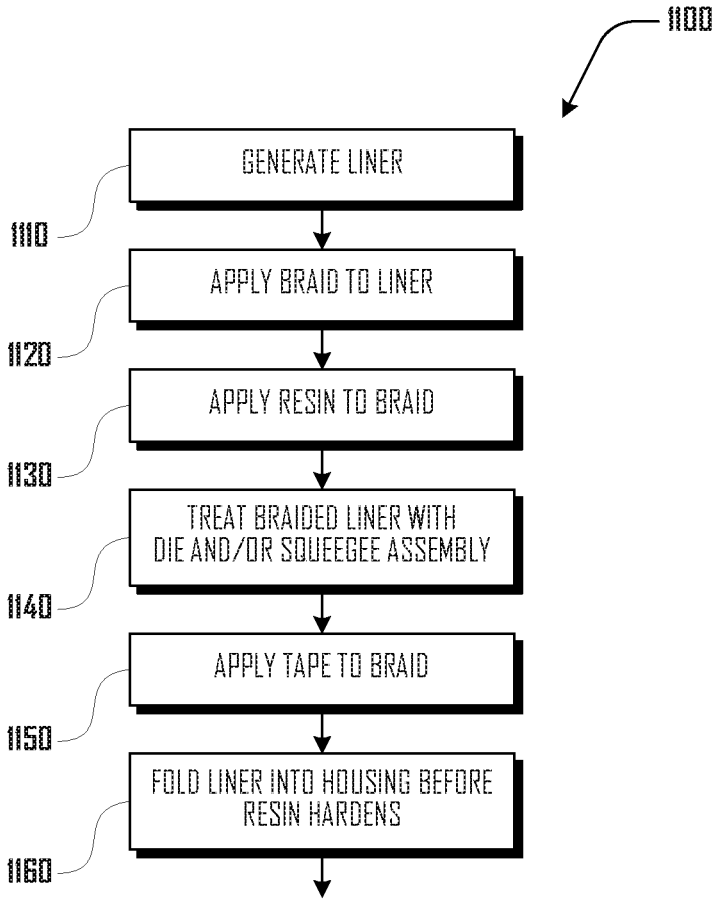
FIG. 11 illustrates another method of making a treated liner in accordance with another embodiment.

FIG. 11 illustrates a method 1100 of generating treated liner in accordance with another embodiment. The method 1100 begins in block 1110, where the liner 550 is generated, and in block 1120, a braid (and/or filament covering) is applied to the liner 550. In block 1130 resin in applied to the braid (and/or filament covering), and in block 1140, the braid (and/or filament covering) is treated with a die and/or squeegee assembly. In block 1150, tape is applied to the braid (and/or filament covering), and in block 1160, the treated liner is folded into a housing 560 before the resin hardens or cures or before the resin is hardened or cured.

Figure 12:
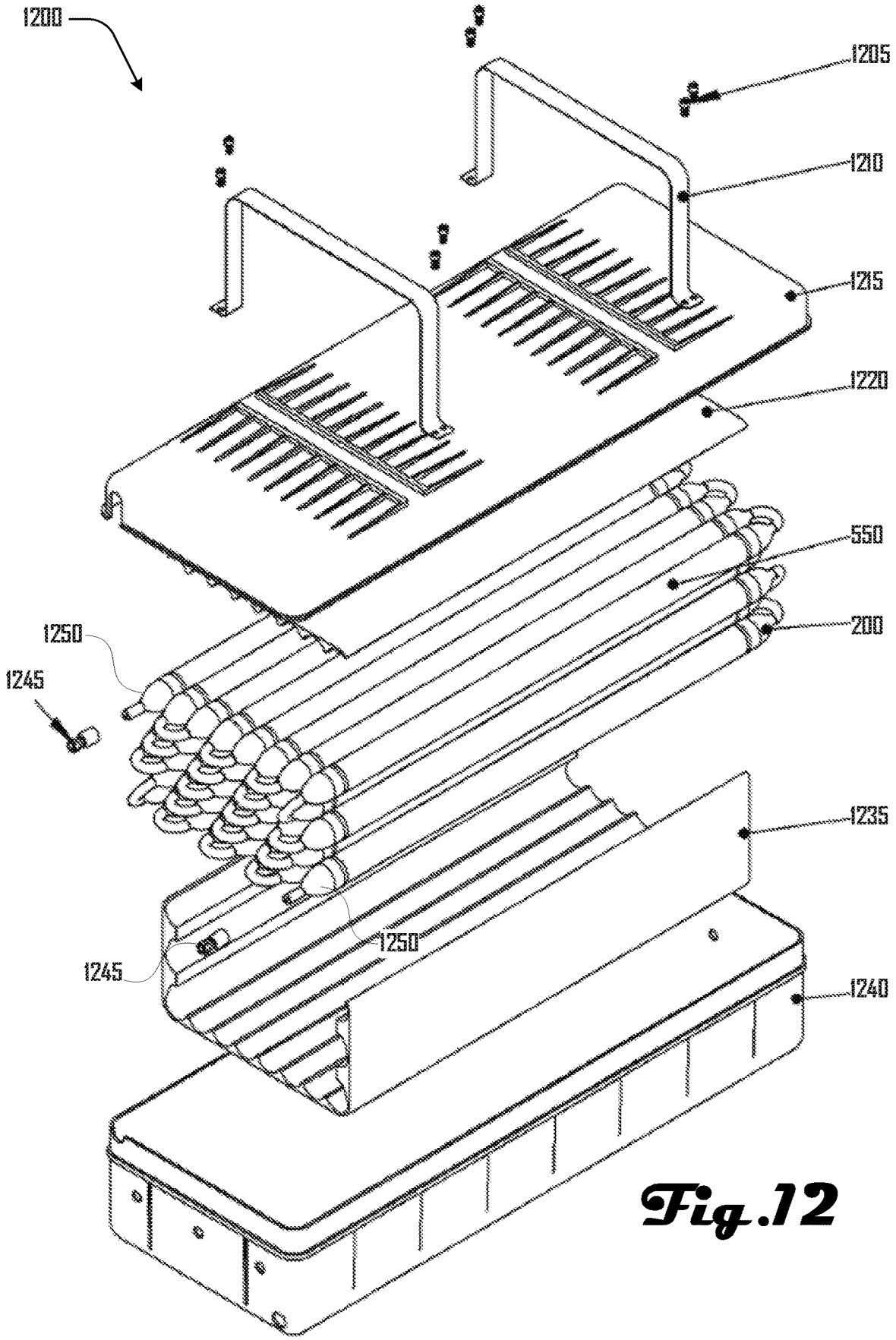
FIG. 12 is an exploded view of a liner assembly in accordance with an embodiment.
Figure 13:
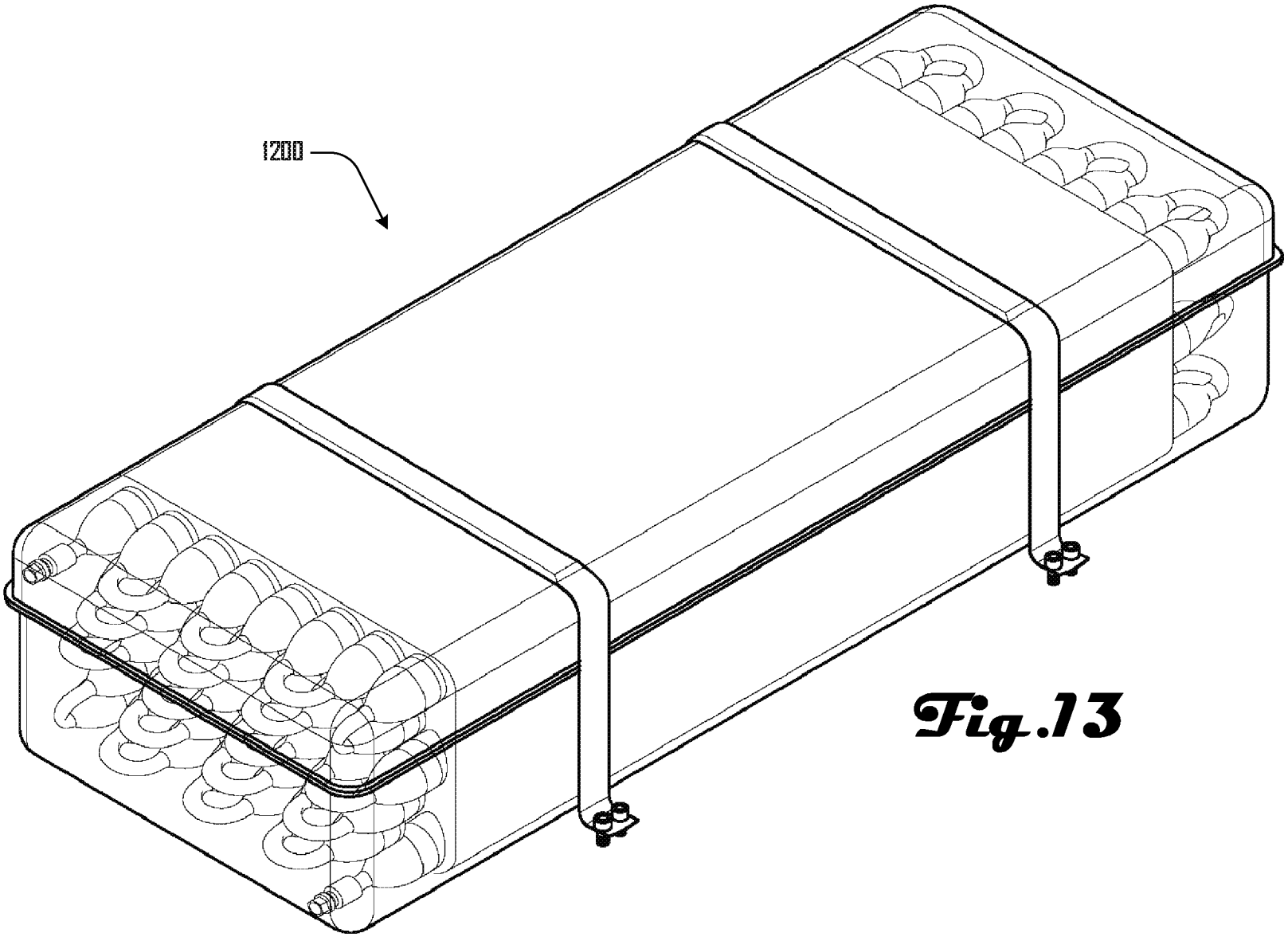
FIG. 13 is a perspective view of the assembled liner assembly of FIG. 12.

FIG. 12 is an exploded view of a liner assembly 1200 in accordance with an embodiment, and FIG. 13 is a perspective view of the assembled liner assembly 1200 shown in FIG. 12. As shown in FIG. 12, the liner assembly 1200 can comprise a liner 550 that resides within, and is surrounded by, a casing bottom 1235 and a casing top 1220. The liner 550 and the casing parts 1235, 1220 can reside with a case bottom 1240, and can be enclosed by a case top 1215. Mounting straps 1210 can surround the case top and bottom 1215, 1240 and be secured to a substrate via mounting hardware 1205. Crimp fittings 1245 can be coupled to ends 1250 of the liner 550 to provide fluid ports.

Figure 16:
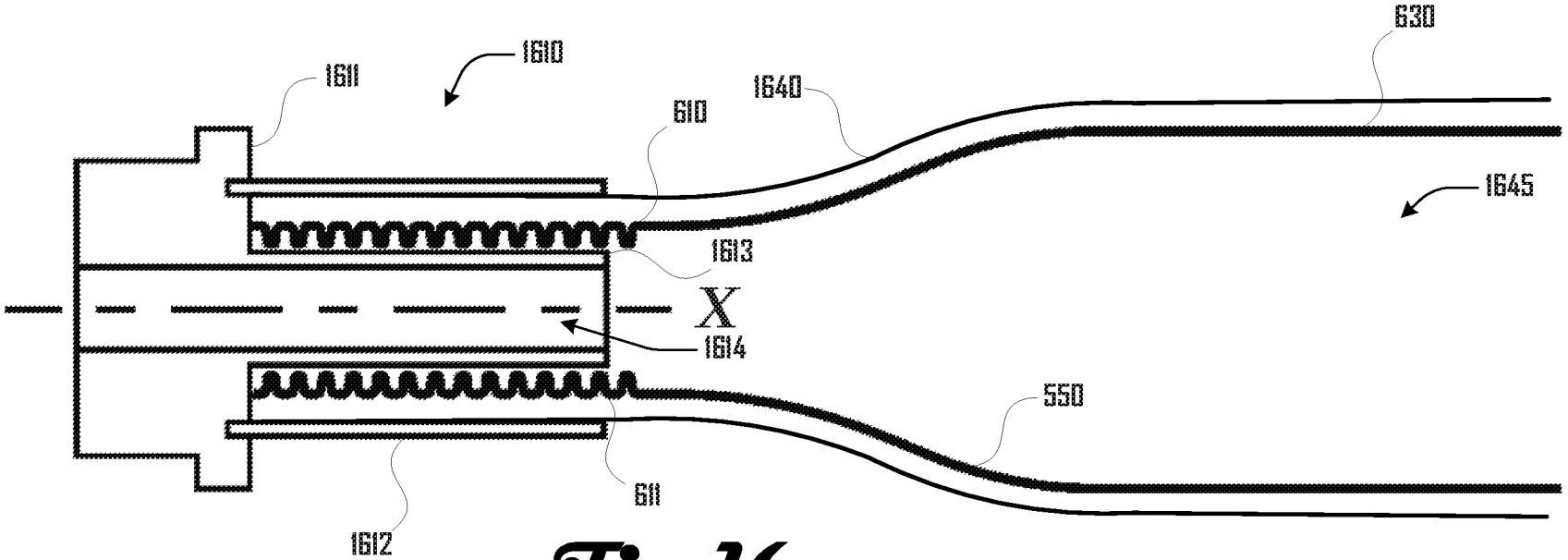
FIG. 16 illustrates an example embodiment of an end-coupling in accordance with an embodiment.

FIG. 16 illustrates one example embodiment of an end-coupling 1610 in accordance with an embodiment that is coupled to an end of a liner 550 that is covered with a braid 1640. The end-coupling 1610 comprises a head 1611 from which an external and internal shaft 1612, 1613 extend along a shared axis X. The external shaft 1612 can surround and reside over the braid 1640 and the internal shaft 1612 can reside within a cavity 1645 defined by the liner 550 and abutting corrugations 611 of a connector portion 610 of the liner 550 having a smaller diameter than a tubing portion 630. In some embodiments, the external and/or internal shaft 1612, 1613 can extend over and surround only a portion of the liner 550 comprising corrugations 610, but in some embodiments can extend over and surround a portion of the liner 550 comprising corrugations 610 and/or non-corrugated portions of the liner 550.

The internal shaft 1613 and head 1611 can define a port 1614 that communicates with the cavity 1645. According, the end-coupling 1610 can provide for fluid entering and/or leaving the cavity 1645 defined by the liner 550. In some embodiments, the end-coupling 1610 can comprise a crimp fitting wherein the external shaft 1612, or an associated structure, are crimped to be coupled with the liner 550 and/or braid 1640.

Such crimp fittings can also include the use of glues, adhesives, or the like. For example, in embodiments where external and/or internal shaft 1612, 1613 extend over and surround a portion of the liner 550 comprising corrugations 610, it can be desirable to have a glue, adhesive or other filler material to fill gaps or spaces within corrugations 610, which can improve coupling between the fitting and the liner 550.

The described embodiments are susceptible to various modifications and alternative forms, and specific examples thereof have been shown by way of example in the drawings and are herein described in detail. It should be understood, however, that the described embodiments are not to be limited to the particular forms or methods disclosed, but to the contrary, the present disclosure is to cover all modifications, equivalents, and alternatives.

What is claimed is:

1. A pressure vessel for storing pressurized fluid, the pressure vessel comprising:

an elongated polymer liner having a liner body that defines:

a liner cavity;

a plurality of flexible connector portions that include a central corrugated length that provides for flexibility of the respective connector portions and rigid elongated non-corrugated ends on opposing sides of the central corrugated length, the connector portions having a first maximum diameter defined by the rigid elongated non-corrugated ends and corrugation ridges of the corrugated length;

a plurality of elongated rigid tubing portions between the respective flexible connector portions, the elongated tubing portions having a second minimum diameter that is larger than the first maximum diameter of the flexible connector portions;

a plurality of taper portions coupling adjoining the rigid elongated non-corrugated ends of the flexible connector portions and rigid tubing portions configured to that provide a gradual taper transition between a smaller diameter of the rigid elongated non-corrugated ends of the connector portion and a larger diameter of the tubing portion; and a first and second end;

a rigid resinated braid that contiguously covers the flexible connector portions, the rigid tubing portions, and the taper portions; and a first and second end-coupling respectively coupled at the first and second end configured to provide for pressurized fluid entering and leaving the cavity.

2. The pressure vessel of claim 1, wherein the elongated polymer liner is configured to assume a straight configuration with the flexible connector portions, the rigid tubing portions, and the taper portions aligned along a common axis; and wherein the liner is configured to assume a folded configuration with the rigid tubing portions disposed along separate and parallel axes, with a plurality of the flexible connector portions being bent in a C-shape.

3. The pressure vessel of claim 1, wherein the liner body comprises a plurality of layers that comprise a different polymer material.

4. The pressure vessel of claim 1, wherein the first and second ends are respectively defined by flexible connector portions; and wherein the first and second end-coupling respectively comprise a crimp fitting that surrounds and is coupled about an elongated corrugated portion of the respective flexible connector portions that respectively define the first and second ends.

5. A vessel for storing fluid, the vessel comprising:

a liner having a liner body that defines:

a liner cavity;

a plurality of flexible connector portions that include a corrugated length that provides for flexibility of the respective connector portions, with the corrugated length being centrally located between rigid elongated non-corrugated ends on opposing sides of the centrally located corrugated length, the connector portions having a first maximum diameter;

a plurality of elongated tubing portions between the respective flexible connector portions, the elongated tubing portions having a second minimum diameter that is larger than the first maximum diameter of the flexible connector portions;

a plurality of taper portions coupling adjoining flexible connector portions and tubing portions configured to that provide a gradual taper transition between a smaller diameter of the connector portion and a larger diameter of the tubing portion; and a first and second end.

6. The vessel of claim 5, further comprising a braid that covers the flexible connector portions, the tubing portions, and the taper portions, and at least a portion of the braid being disposed in a rigid resin.

7. The vessel of claim 5, further comprising a first and second end-coupling respectively coupled at a respective flexible connector defining the first and second end, the first and second end-coupling configured to provide for fluid entering and leaving the cavity.

8. The vessel of claim 5, wherein the liner is configured to store compressed natural gas within the liner cavity.

9. The vessel of claim 5, wherein the liner is configured to store hydrogen within the liner cavity.

10. The vessel of claim 5, wherein the liner body comprises a plurality of separate layers defined respectively by a different first and second polymer material.

11. The vessel of claim 10, wherein the different first and second polymer material respectively consist essentially of comprise one of nylon, ethylene vinyl alcohol and polyethylene.

12. The vessel of claim 5, wherein the liner is configured to assume a straight configuration with the flexible connector portions, the tubing portions, and the taper portions aligned along a common axis; and wherein the liner is configured to assume a folded configuration with the tubing portions disposed along separate and parallel axes, with a plurality of the flexible connector portions being bent at the corrugated lengths.

13. The vessel of claim 5, wherein the tubing portions comprise a corrugated portion.

* * * * *